US007817006B2

(12) United States Patent
Fullerton et al.

(10) Patent No.: US 7,817,006 B2
(45) Date of Patent: Oct. 19, 2010

(54) APPARATUSES AND METHODS RELATING TO PRECISION ATTACHMENTS BETWEEN FIRST AND SECOND COMPONENTS

(75) Inventors: Larry W. Fullerton, New Hope, AL (US); Mark D. Roberts, Huntsville, AL (US); Mitchell Williams, Madison, AL (US)

(73) Assignee: Cedar Ridge Research, LLC., New Hope, AL (US)

( * ) Notice: Subject to any disclaimer, the term of this patent is extended or adjusted under 35 U.S.C. 154(b) by 0 days.

(21) Appl. No.: 12/507,015

(22) Filed: Jul. 21, 2009

(65) Prior Publication Data

US 2009/0289749 A1 Nov. 26, 2009

Related U.S. Application Data

(63) Continuation-in-part of application No. 12/476,952, filed on Jun. 2, 2009.

(51) Int. Cl.
*H01F 7/02* (2006.01)
*H01F 7/20* (2006.01)

(52) U.S. Cl. ..... 335/306; 335/285

(58) Field of Classification Search ..... 335/285, 335/302–306; 24/303; 310/90.5
See application file for complete search history.

(56) References Cited

U.S. PATENT DOCUMENTS 381,968 A 5/1888 N. Tesla
493,858 A 3/1893 Edison
996,933 A 7/1911 Lindquist
1,236,234 A 8/1917 Troje
2,389,298 A 11/1945 Ellis
2,570,625 A 10/1951 Zimmerman et al.

(Continued)

FOREIGN PATENT DOCUMENTS

FR 823395 1/1938

(Continued)

OTHER PUBLICATIONS

"BNS Series-Compatible Series AES Safety Controllers"pp. 1-17, http://www.schmersalusa.com/safety_controllers/drawings/aes.pdf (downloaded on or before Jan. 23, 2009).

(Continued)

*Primary Examiner*—Ramon M Barrera
(74) *Attorney, Agent, or Firm*—Keith W. Saunders; William J. Tucker

(57) ABSTRACT

First and second components may be precisely attached to form an apparatus. In an example embodiment, a first component includes a first field emission structure, and a second component includes a second field emission structure. The first and second components are adapted to be attached to each other with the first field emission structure in proximity to the second field emission structure such that the first and second field emission structures have a predetermined alignment with respect to each other. Each of the first and second field emission structures include multiple field emission sources having positions and polarities relating to a predefined spatial force function that corresponds to the predetermined alignment of the first and second field emission structures within a field domain. The first and second field emission structures are configured responsive to at least one precision criterion to enable a precision attachment.

20 Claims, 17 Drawing Sheets

U.S. PATENT DOCUMENTS

| | | | |
|---|---|---|---|
| 2,722,617 | A | 11/1955 | Cluwen et al. |
| 3,102,314 | A | 9/1963 | Alderfer |
| 3,208,296 | A | 9/1965 | Baermann |
| 3,288,511 | A | 11/1966 | Tavano |
| 2,932,545 | A | 4/1969 | Foley |
| 3,468,576 | A | 9/1969 | Beyer et al. |
| 3,474,366 | A | 10/1969 | Barney |
| 3,802,034 | A | 4/1974 | Bookless |
| 4,079,558 | A | 3/1978 | Gorham |
| 4,222,489 | A | 9/1980 | Hutter |
| 4,453,294 | A | 6/1984 | Morita |
| 4,547,756 | A | 10/1985 | Miller et al. |
| 4,629,131 | A | 12/1986 | Podell |
| 4,941,236 | A | 7/1990 | Sherman |
| 5,050,276 | A | 9/1991 | Pemberton |
| 5,367,891 | A | 11/1994 | Furuyama |
| 5,383,049 | A | 1/1995 | Carr |
| 5,631,093 | A | 5/1997 | Perry et al. |
| 5,631,618 | A | 5/1997 | Trumper et al. |
| 6,072,251 | A | 6/2000 | Markle |
| 6,170,131 | B1 | 1/2001 | Shin |
| 6,275,778 | B1 | 8/2001 | Shimada et al. |
| 6,457,179 | B1 | 10/2002 | Prendergast |
| 6,607,304 | B1 | 8/2003 | Lake et al. |
| 6,720,698 | B2 | 4/2004 | Galbraith |
| 6,847,134 | B2 | 1/2005 | Frissen et al. |
| 6,862,748 | B2 | 3/2005 | Prendergast |
| 6,927,657 | B1 | 8/2005 | Wu |
| 6,971,147 | B2 | 12/2005 | Halstead |
| 7,066,778 | B2 | 6/2006 | Kretzschmar |
| 7,362,018 | B1 | 4/2008 | Kulogo et al. |
| 7,444,683 | B2 | 11/2008 | Prendergast et al. |
| 2004/0003487 | A1 | 1/2004 | Reiter |
| 2006/0066428 | A1 | 3/2006 | McCarthy et al. |
| 2006/0189259 | A1 | 8/2006 | Park |
| 2006/0290451 | A1 | 12/2006 | Prendergast et al. |
| 2008/0186683 | A1 | 8/2008 | Ligtenberg et al. |
| 2008/0272868 | A1 | 11/2008 | Prendergast et al. |
| 2008/0282517 | A1 | 11/2008 | Claro |

FOREIGN PATENT DOCUMENTS

| | | | |
|---|---|---|---|
| WO | 2007081830 | A2 | 7/2007 |
| WO | WO 2007081830 | A2 * | 7/2007 |

OTHER PUBLICATIONS

"Magnetic Safety Sensors"pp. 1-3, http://farnell.com/datasheets/6465.pdf (downloaded on or before Jan. 23, 2009).

"Series BNS-B20 Coded-Magnet Sensor Safety Door Handle" pp. 1-2, http://www.schmersalusa.com/catalog_pdfs/BNS_B20.pdf (downloaded on or before Jan. 23, 2009).

"Series BNS333 Coded-Magnet Sensors with Integrated Safety Control Module" pp. 1-2, http://www.schmersalusa.com/machine_guarding/coded_magnet/drawings/bns333.pdf (downloaded on or before Jan. 23, 2009).

* cited by examiner

FIG. 3B
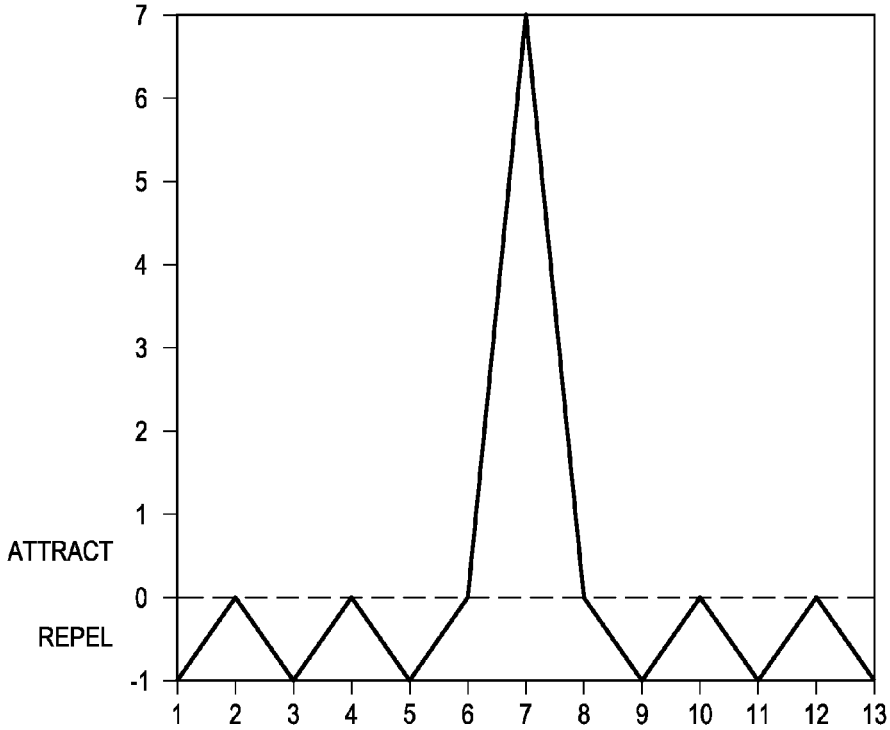
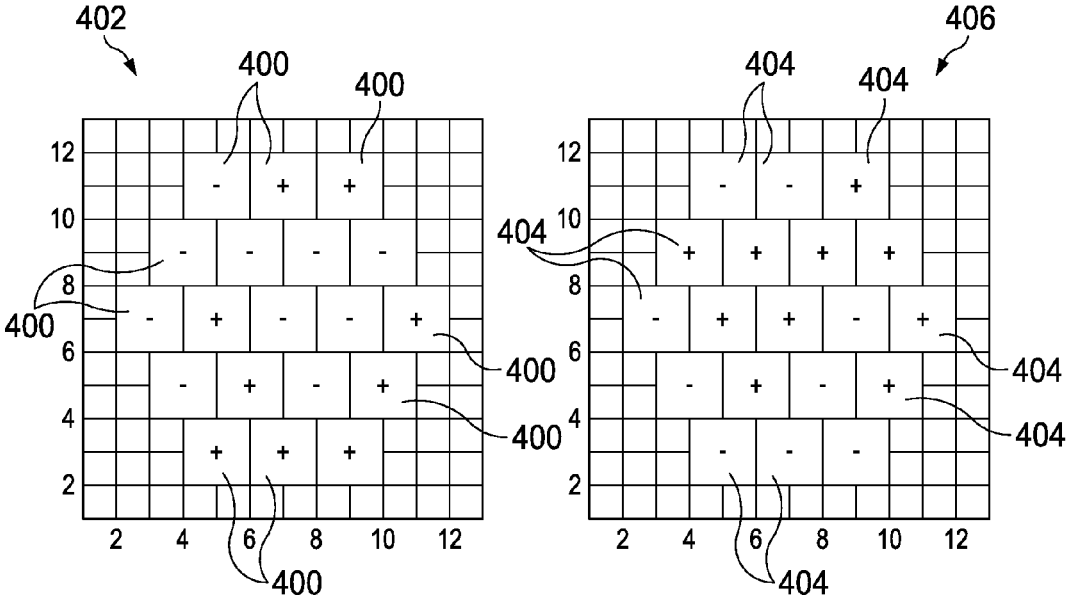
FIG. 4A

APPARATUSES AND METHODS RELATING TO PRECISION ATTACHMENTS BETWEEN FIRST AND SECOND COMPONENTS

CROSS REFERENCES TO RELATED APPLICATIONS

This application is a continuation-in-part application of U.S. patent application Ser. No. 12/476,952 filed on Jun. 2, 2009 and entitled "A Field Emission System and Method", which is a continuation-in-part application of U.S. patent application Ser. No. 12/322,561 filed on Feb. 4, 2009 and entitled "A System and Method for Producing an Electric Pulse", which is a continuation-in-part application of U.S. patent application Ser. No. 12/358,423 filed on Jan. 23, 2009 and entitled "A Field Emission System and Method", which is a continuation-in-part application of U.S. patent application Ser. No. 12/123,718 filed on May 20, 2008 and entitled "A Field Emission System and Method". The contents of these four documents are hereby incorporated herein by reference.

TECHNICAL FIELD

The present invention is related to apparatuses and methods that incorporate correlated magnets for precisely attaching first and second components. By way of example but not limitation, components that may be precisely attached to one another to form apparatuses may relate to one or more of the following categories: optical equipment, surveying equipment, manufacturing equipment, medical equipment, some combination thereof, and so forth.

DESCRIPTION OF RELATED ART

Many tools, devices, and other equipment that are used today are formed from multiple parts. One part is connected to another part so that the overall apparatus is capable of performing an intended task or function. In order for the apparatus to properly accomplish the intended task or function, the two parts may need to be connected to each other such that they are aligned within a desired tolerance level, which corresponds to a maximum allowable deviation from a nominal value. Traditionally, these two parts would be connected and then manually calibrated by fine tuning their relative positions.

For example, the position of a gun scope relative to the rifle to which it is attached is typically fine tuned so that the cross hairs will accurately reflect the trajectory/target of a bullet to be fired by the rifle. Measurement marks and/or a cutting blade on a jigsaw are calibrated so that the resulting cuts will be made accurately. Unfortunately, this traditional manual approach to calibration is tedious and time consuming.

Moreover, many traditional mechanisms for securing and/or calibrating two parts are relatively impermanent. In other words, the relative positions of the two parts can drift over time, such as through rough contact or mechanical vibrations, because the mechanisms used to secure the parts are not sufficiently stable and immobile. The desired relative positioning of the two parts is therefore often maintained with periodic maintenance and recalibration. Unfortunately, the manual calibrations and periodic recalibrations are expensive and time consuming.

Thus, it is apparent that conventional approaches to precisely aligning two parts of an apparatus entail significant manual adjustment. Conventional approaches also often entail periodic update adjustments to maintain calibrated components to a desired level of tolerance. These and other deficiencies in the existing art are addressed by one or more of the example embodiments of the invention that are described herein.

SUMMARY

First and second components may be precisely attached to form an apparatus. In an example embodiment, an apparatus comprises a first component and a second component. The first component includes a first field emission structure. The second component includes a second field emission structure. The first and second components are adapted to be attached to each other with the first field emission structure in proximity to the second field emission structure such that the first and second field emission structures have a predetermined alignment with respect to each other. Each of the first and second field emission structures include multiple field emission sources having positions and polarities relating to a predefined spatial force function that corresponds to the predetermined alignment of the first and second field emission structures within a field domain. The first and second field emission structures are configured responsive to at least one precision criterion to enable a precision attachment.

In yet another example embodiment, a method relates to an apparatus including a first component and a second component. In the method, a first field emission structure is disposed on the first component. A second field emission structure is disposed on the second component. The first and second components are adapted to be attached to each other with the first field emission structure in proximity to the second field emission structure such that the first and second field emission structures have a predetermined alignment with respect to each other. Each of the first and second field emission structures include multiple field emission sources having positions and polarities relating to a predefined spatial force function that corresponds to the predetermined alignment of the first and second field emission structures within a field domain. The first and second field emission structures are configured responsive to at least one precision criterion.

In another example embodiment, a first component is capable of being attached to a second component, with the second component including a second field emission structure. The first component comprises a body and a second field emission structure. The second field emission structure is disposed on the body of the first component. The first component is adapted to be attached to the second component with the first field emission structure in proximity to the second field emission structure such that the first and second field emission structures have a predetermined alignment with respect to each other. Each of the first and second field emission structures include multiple field emission sources having positions and polarities relating to a predefined spatial force function that corresponds to the predetermined alignment of the first and second field emission structures within a field domain. The first and second field emission structures are configured responsive to at least one precision criterion.

Additional embodiments and aspects of the invention are set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed or claimed.

BRIEF DESCRIPTION OF THE DRAWINGS

A more complete understanding of the present invention may be obtained by reference to the following detailed description when taken in conjunction with the accompanying drawings. The individual elements shown in the drawings are not necessarily illustrated to scale.

DETAILED DESCRIPTION

Figure 1:
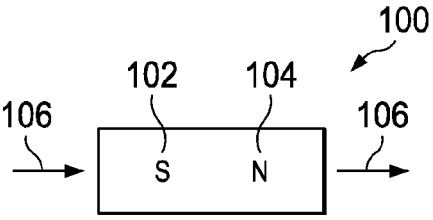
FIGS. 1-9 are various diagrams that are used to help explain different example concepts about correlated magnetic technology, which can be utilized in certain embodiments of the present invention.

Certain embodiments of the present invention relate to apparatuses that have a first component and a second component that may be attached to each other. In certain example implementations, each of the first component and the second component incorporate at least one correlated magnetic structure that enables the first component and the second component to be attached (e.g., removably connected) to each other with a predetermined precision or tolerance level. Apparatuses having precisely-attached components may be used for many purposes. Example purposes include, but are not limited to, optics, surveying, manufacturing, medical care, combinations thereof, and so forth. More specific examples include, but are not limited to, a gun scope or camera; a tripod or leveling apparatus; a metalworking or woodworking machine, a robotic machine, a semiconductor fabrication machine; an X-ray or other imaging machine; and so forth. Certain embodiments of the present invention are made possible, at least in part, by utilizing an emerging, revolutionary technology that is herein termed "correlated magnetics".

Correlated magnetics was first fully described and enabled in the co-assigned U.S. patent application Ser. No. 12/123,718 filed on May 20, 2008 and entitled "A Field Emission System and Method". The contents of this document are hereby incorporated herein by reference. A second generation of correlated magnetic technology is described and enabled in the co-assigned U.S. patent application Ser. No. 12/358,423 filed on Jan. 23, 2009 and entitled "A Field Emission System and Method". The contents of this document are hereby incorporated herein by reference. A third generation of correlated magnetic technology is described and enabled in the co-assigned U.S. patent application Ser. No. 12/476,952 filed on Jun. 2, 2009 and entitled "A Field Emission System and Method". The contents of this document are hereby incorporated herein by reference. Another technology known as correlated inductance, which is related to correlated magnetics, has been described and enabled in the co-assigned U.S. patent application Ser. No. 12/322,561 filed on Feb. 4, 2009 and entitled "A System and Method for Producing an Electric Pulse". The contents of this document are hereby incorporated herein by reference. A brief description of correlated magnetics is provided immediately below. Thereafter, example embodiments are described for utilizing correlated magnetics to enable first and second components to be precisely attached to each other (e.g., for forming an apparatus capable of achieving a desired functionality).

Correlated Magnetics Technology

This section is provided to review basic magnets and to introduce aspects of the new and revolutionary correlated magnetic technology. This section includes subsections relating to basic magnets, correlated magnets, and correlated electromagnetics. It should be understood that this section is provided to assist the reader with understanding the present invention by explaining basic concepts of correlated magnetics and by presenting a set of examples—it should not be used to limit the scope of the present invention.

A. Magnets

A magnet is a material or object that produces a magnetic field which is a vector field that has a direction and a magnitude (also called strength). Referring to FIG. 1, there is illustrated an exemplary magnet 100 which has a South pole 102 and a North pole 104 and magnetic field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively. Hence, magnetic polarity may be expressed in terms of North and South polarities or positive and negative polarities.

Figure 2A:
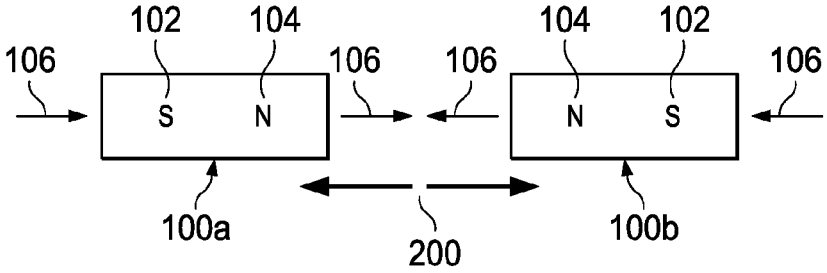
Figure 2B:
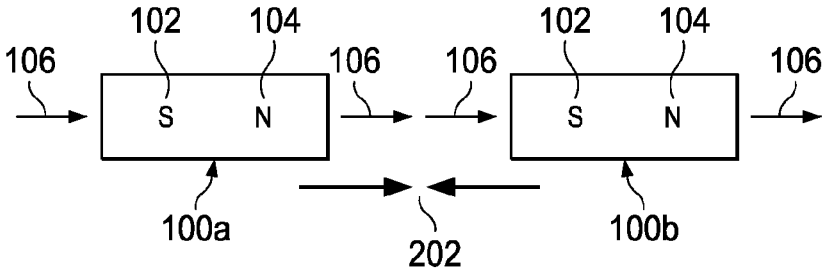
Figure 2C:
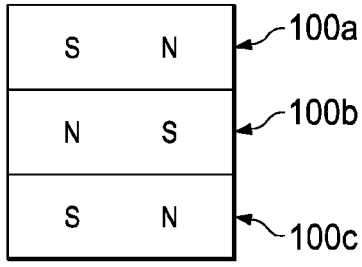

Referring to FIG. 2A, there is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aligned with one another but they can also be partially aligned with one another where they could still "stick" to each other and maintain their positions relative to each other. FIG. 2C is a diagram that illustrates how magnets 100*a*, 100*b*, and 100*c* will naturally stack on one another such that their poles alternate.

B. Correlated Magnets

Correlated magnets can be created in a wide variety of ways depending on the particular application as described in the aforementioned U.S. patent application Ser. Nos. 12/123,718, 12/358,432, and 12/476,952 by using a combination of magnet arrays (referred to herein as magnetic field emission sources that form magnetic field emission structures), correlation theory (commonly associated with probability theory and statistics) and coding theory (commonly associated with communication systems). A brief discussion is provided next to explain how these widely diverse technologies are utilized in a novel way to create correlated magnets.

Generally, correlated magnets may be made from a combination of magnetic (or electric) field emission sources which have been configured in accordance with a pre-selected code having desirable correlation properties. Thus, when a magnetic field emission structure is brought into alignment with a complementary, or mirror image, magnetic field emission structure the various magnetic field emission sources will align causing a peak spatial attraction force to be produced, while a misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources align causing a peak spatial repelling force to be produced, while a misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions may be used, for example, to achieve precision alignment and precision positioning that are not possible with basic magnets. Moreover, the spatial force functions can enable the precise control of magnetic fields and associated spatial forces thereby enabling, for example: (i) new forms of attachment devices and mechanisms for attaching objects with precise alignment and (ii) new systems and methods for controlling precision movement of objects. An additional characteristic associated with correlated magnets relates to a situation where the various magnetic field sources making-up two magnetic field emission structures can effectively cancel each other out when they are brought out of alignment, which is described herein as a release force. This release force is a direct result of the particular correlation coding used to configure the magnetic field emission structures.

A person skilled in the art of coding theory will recognize that there are many different types of codes that have different correlation properties, some of which have been used in communications for channelization purposes, energy spreading, modulation, and other purposes. Many of the basic characteristics of such codes make them applicable for use in producing the magnetic field emission structures described herein. For example, Barker codes are known for their autocorrelation properties and can be used to help configure correlated magnets. Although a Barker code is used in an example below with respect to FIGS. 3A-3B, other forms of codes which may or may not be well known in the communications or other arts are also applicable to correlated magnets because of their autocorrelation, cross-correlation, or other properties. Example codes include, but are not limited to, Gold codes, Kasami sequences, hyperbolic congruential codes, quadratic congruential codes, linear congruential codes, Welch-Costas array codes, Golomb-Costas array codes, pseudorandom codes, chaotic codes, Optimal Golomb Ruler codes, deterministic codes, designed codes, one dimensional codes, two dimensional codes, three dimensional codes, or four dimensional codes, combinations thereof, and so forth.

Figure 3A:
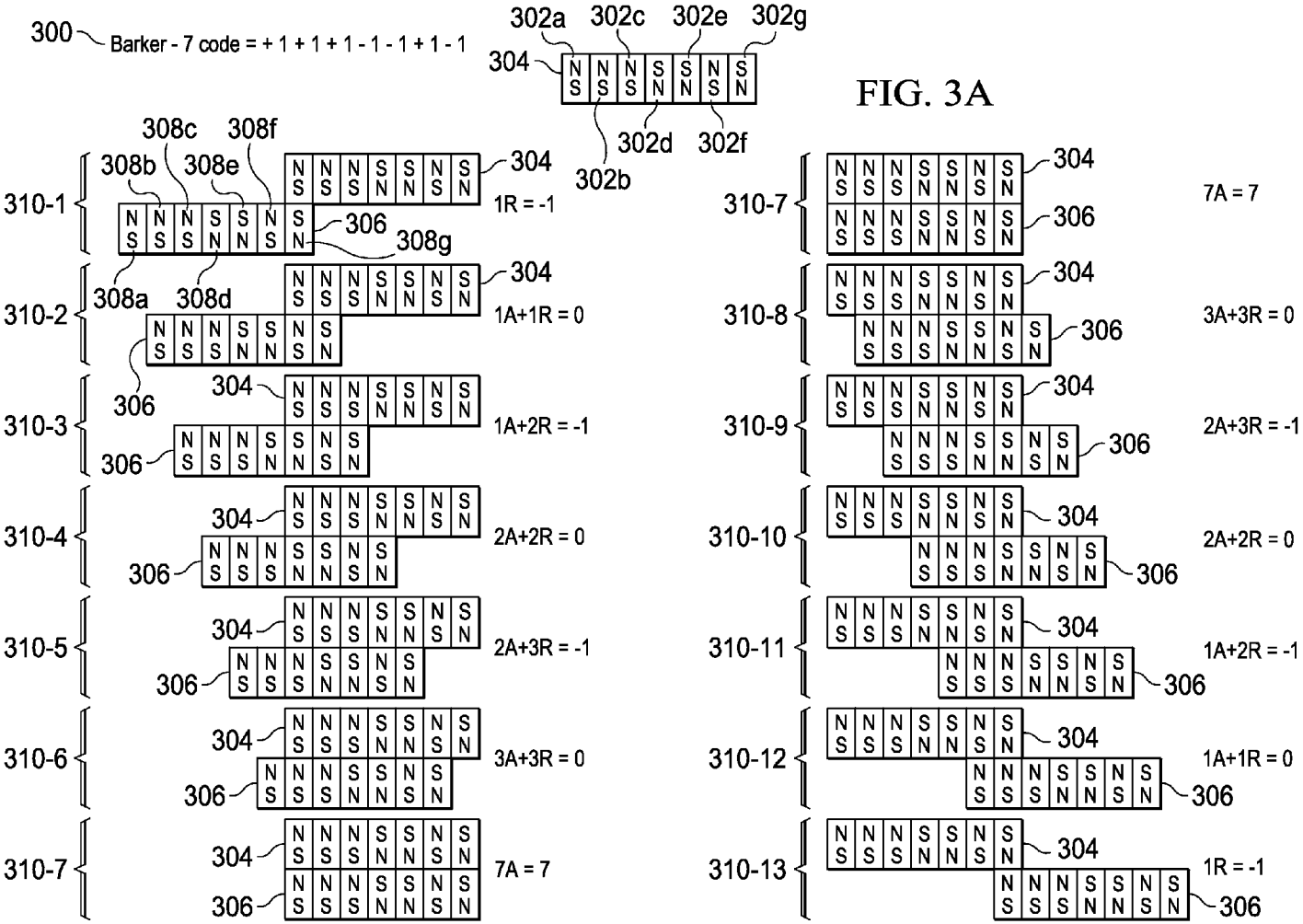

Referring to FIG. 3A, there are diagrams used to explain how a Barker length 7 code 300 can be used to determine polarities and positions of magnets 302*a*, 302*b* . . . 302*g* making up a first magnetic field emission structure 304. Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). It should be noted, however, that different field emission sources within a single given field emission structure may have different field strengths (e.g., +1, −1, +2, −2, +3, −4, etc.). A second magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnets that repel plus the number of magnets that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*.

With the specific Barker code example that is used, the spatial force varies from −1 to 7, where the peak occurs when the two magnetic field emission structures 304 and 306 are aligned, which occurs when their respective codes are aligned. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa). In other words, the two magnetic field emission structures 304 and 306 substantially correlate with one another when they are aligned to substantially mirror each other.

In FIG. 3B, there is a plot that depicts the spatial force function of the two magnetic field emission structures 304 and 306 which results from the binary autocorrelation function of the Barker length 7 code 300, where the values at each alignment position 1 through 13 correspond to the spatial force values that were calculated for the thirteen alignment positions 310-1 through 310-13 between the two magnetic field emission structures 304 and 306 depicted in FIG. 3A. As the true autocorrelation function for correlated magnet field structures is repulsive, and many of the uses currently envisioned have attractive correlation peaks, the usage of the term 'autocorrelation' herein refers to complementary correlation unless otherwise stated. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

Figure 4B:
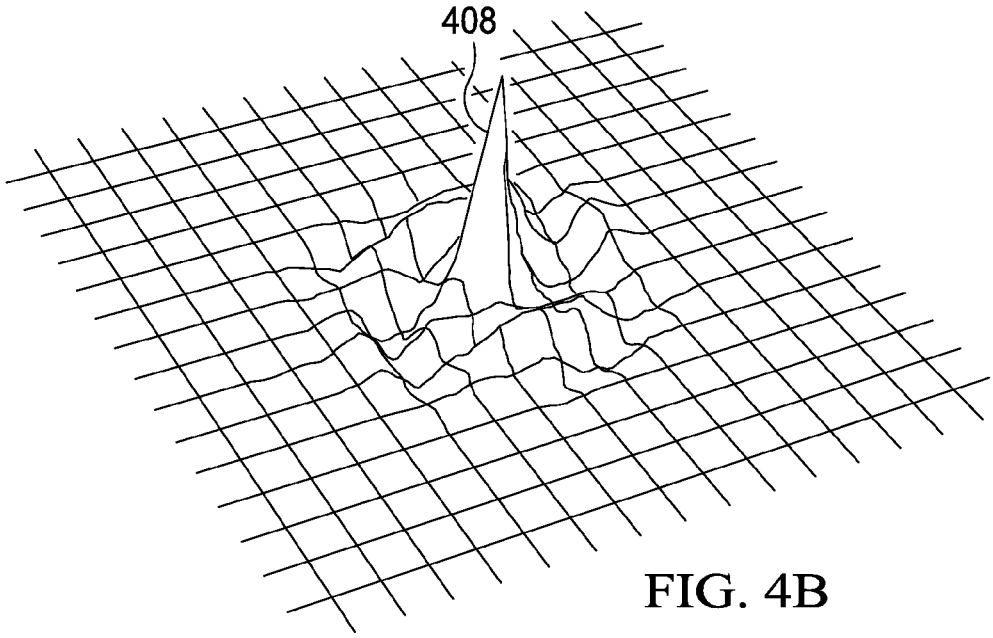
Figure 4C:
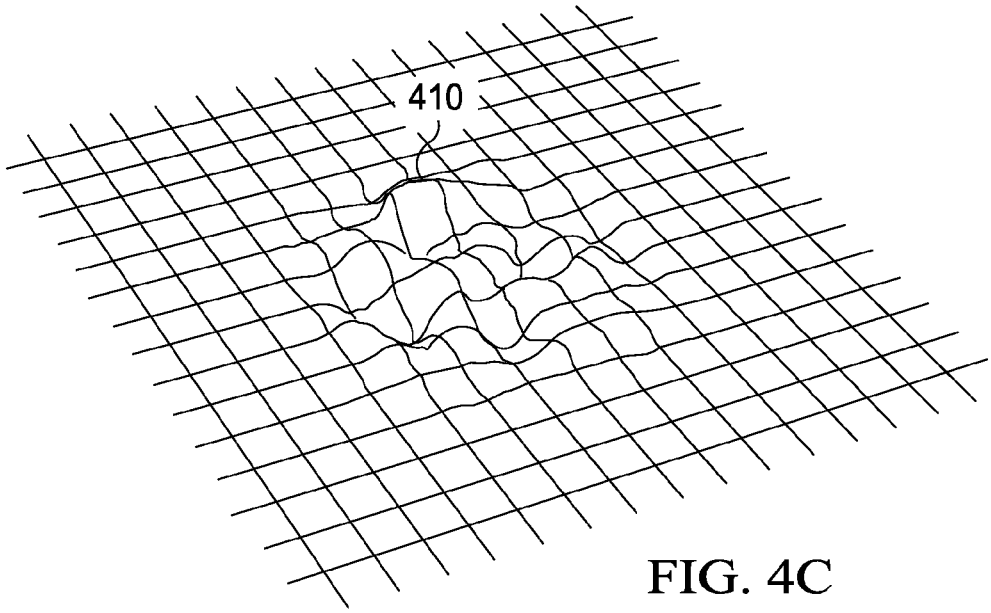

Referring to FIG. 4A, there is a diagram of an array of 19 magnets 400 positioned in accordance with an exemplary code to produce an exemplary magnetic field emission structure 402 and another array of 19 magnets 404 which is used to produce a mirror image magnetic field emission structure 406. In this example, the exemplary code is intended to produce the first magnetic field emission structure 402 to have a first stronger lock when aligned with its mirror image magnetic field emission structure 406 and a second weaker lock when it is rotated 90° relative to its mirror image magnetic field emission structure 406. FIG. 4B depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions, then they can be easily separated given this exemplary code.

Figure 5:
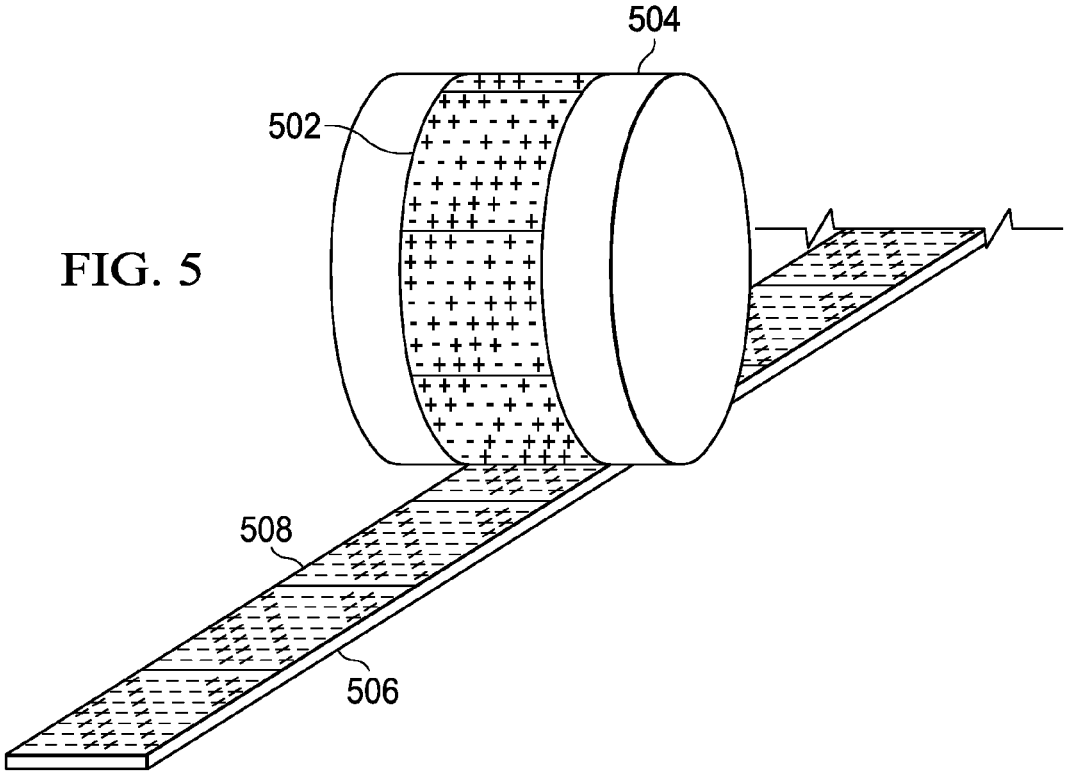

Referring to FIG. 5, there is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force can remain substantially constant as the cylinder 504 moves down the conveyor belt/tracked structure 506 independent of friction or gravity and can therefore be used to move an object about a track that extends up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 can be largely independent of the friction forces between the traction wheel and the traction surface and can be employed with low friction surfaces. Devices moving about based on magnetic traction can be operated independently of gravity, for example in weightless conditions including space, underwater, vertical surfaces and even upside down.

Figure 6:
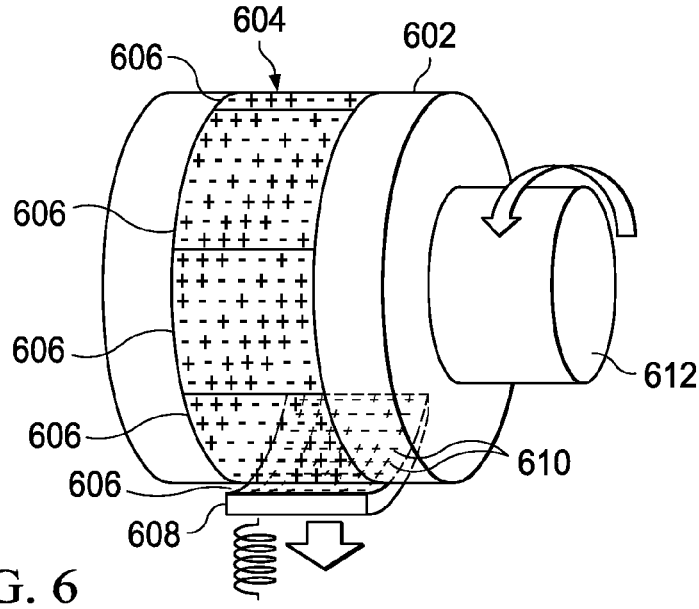

Referring to FIG. 6, there is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume the cylinder 602 is turned at a rotational rate of one rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then six times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610.

One skilled in the art will recognize that the cylinder 602 may be connected to a shaft 612 which may be turned as a result of wind turning a windmill, water turning a water wheel or turbine, ocean wave movement, and other methods whereby movement of the object 608 can result in some source of energy scavenging. Thus, as described with particular reference to FIGS. 5 and 6, correlated magnetics enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, friction forces, static control with a material forming a solid, some combination thereof, and so forth. In other cases, magnet sources of the same magnetic field emission structure can be sparsely separated from other magnets (e.g., in a sparse array) such that the magnetic forces of the individual magnet sources do not substantially interact, in which case the polarity of individual magnet sources can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align, but these magnets can be made to remain in a desired orientation by use of one or more of the above-listed or other holding mechanisms. As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, a structural assembly, combinations thereof, and so forth.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

Figure 7:
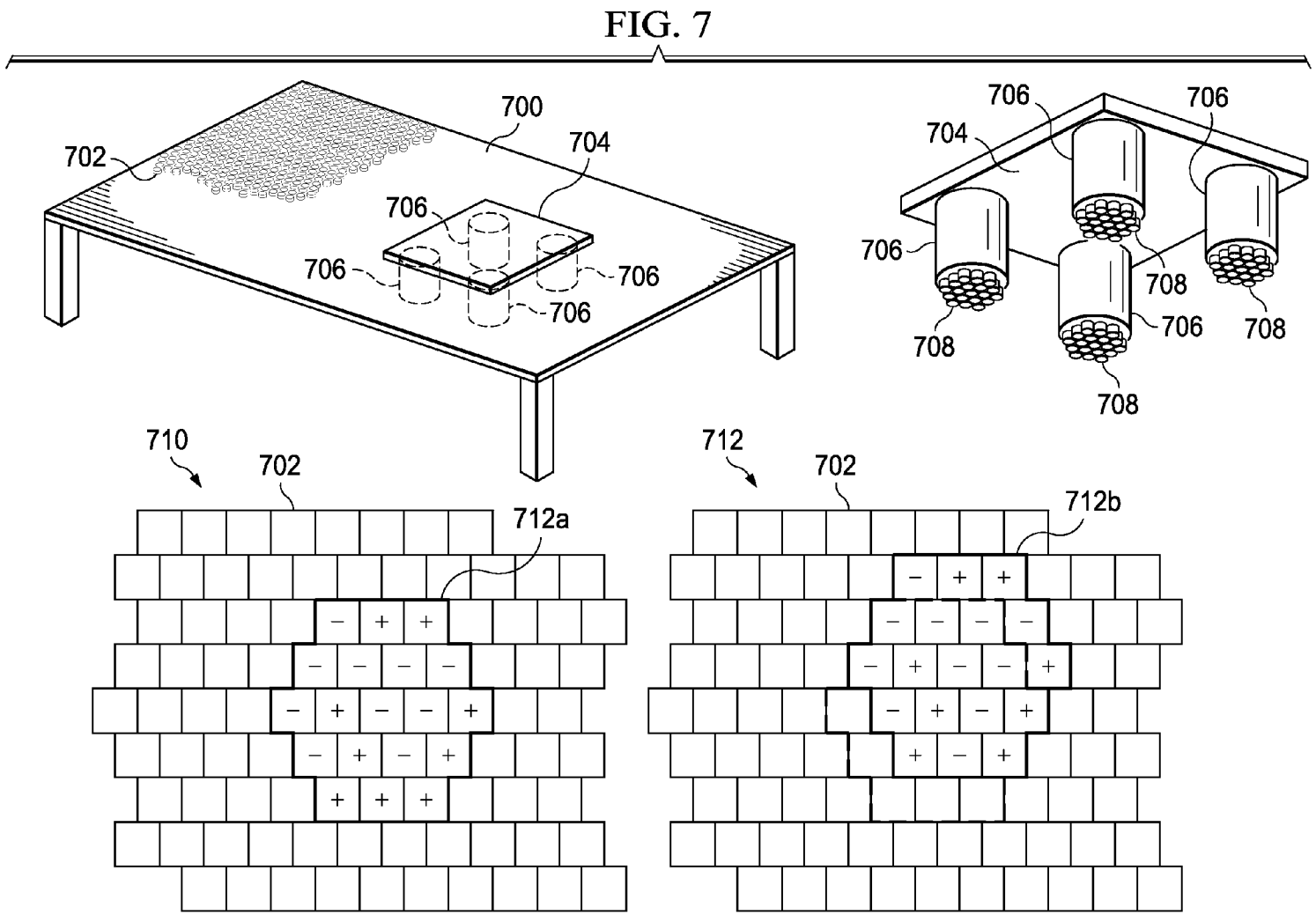

Referring to FIG. 7, there are several diagrams used to explain a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts states of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, one skilled in the art can recognize that the table contact member(s) 706 can be moved about table 700 by varying the states of the electromagnets of the electromagnetic array 702.

Figure 8:
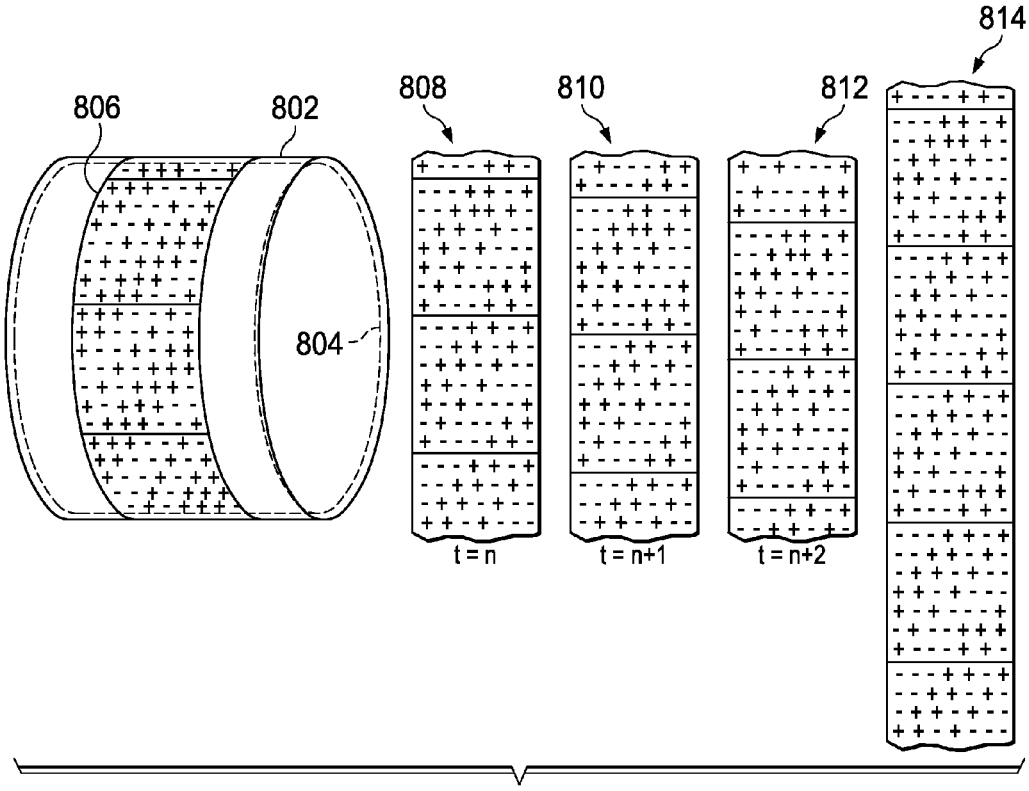

Referring to FIG. 8, there are several diagrams used to explain a 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
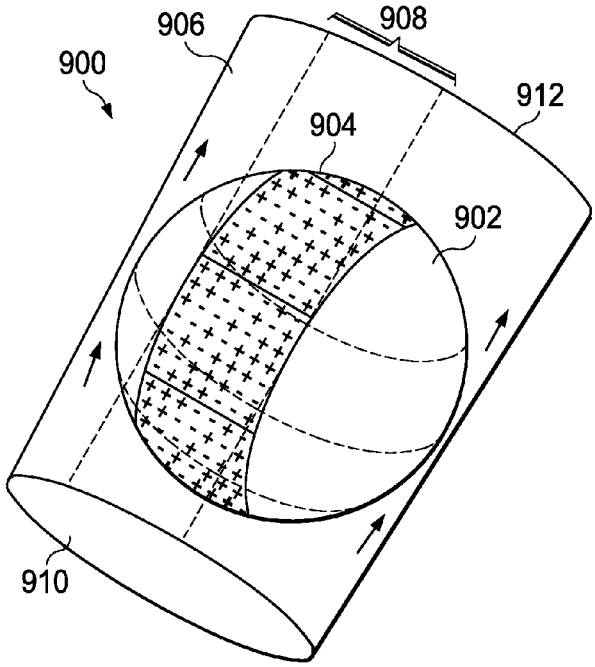

Referring to FIG. 9, there is illustrated an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve.

Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. One skilled in the art will recognize that many different types of seal mechanisms that include gaskets, o-rings, and the like can be employed with the use of the correlated magnets. Plus, one skilled in the art will recognize that the magnetic field emission structures can have an array of emission sources including, for example, a permanent magnet, an electromagnet, an electret, a magnetized ferromagnetic material, a portion of a magnetized ferromagnetic material, a soft magnetic material, or a superconductive magnetic material, some combination thereof, and so forth.

Figure 10:
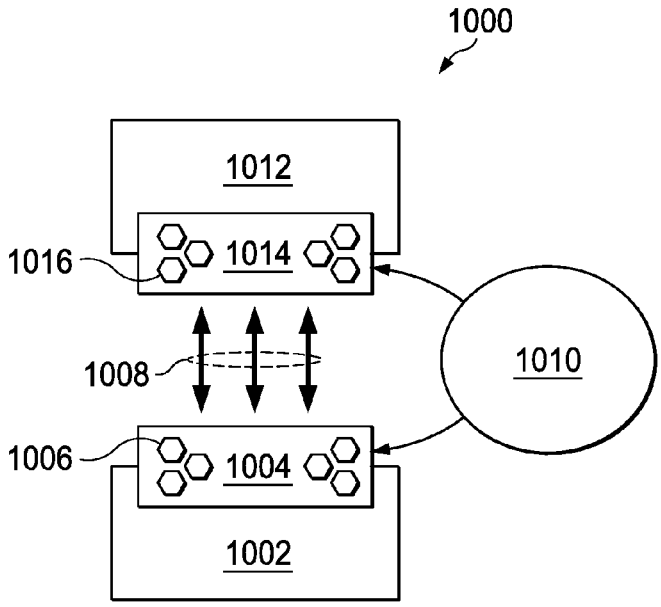
FIG. 10 is a block diagram illustrating example first and second components that may be precisely attached to each other via first and second field emission structures using a relative movement.

Correlated Magnetic Apparatuses and Methods for Precisely Attaching First and Second Components FIG. 10 is a block diagram illustrating example first and second components 1002 and 1012 that may be precisely attached to each other via first and second field emission structures 1004 and 1014 using a relative movement between them. As illustrated, an example apparatus 1000 includes a first component 1002, a first field emission structure 1004, a second component 1012, a second field emission structure 1014, and multiple field emission sources 1006 and 1016. The first and second components 1002 and 1012 may be any two parts of a given apparatus 1000, as is indicated by the examples that are described herein and illustrated in the accompanying diagrams.

In an example embodiment, an apparatus 1000 includes a first component 1002 and a second component 1012. The first component 1002 includes a first field emission structure 1004. The first field emission structure 1004 comprises multiple field emission sources 1006. The second component 1012 includes a second field emission structure 1014. The second field emission structure 1014 comprises multiple field emission sources 1016. Although not separately indicated, each of the first component 1002 and the second component 1012 includes a body portion.

The first and second components 1002 and 1012 are adapted to be attached to each other with the first field emission structure 1004 in proximity to the second field emission structure 1014 such that the first and second field emission structures 1004 and 1014 have a predetermined alignment with respect to each other. Each of the first and second field emission structures 1004 and 1014 include the multiple field emission sources 1006 and 1016 having positions and polarities relating to a predefined spatial force function that corresponds to the predetermined alignment of the first and second field emission structures 1004 and 1014 within a field domain 1008. Although the field domain 1008 is illustrated in a specific manner, a given field domain 1008 may simultaneously include multiple attractive and/or repulsive forces between the field emission sources 1006 and 1016. The first and second field emission structures 1004 and 1014 are configured responsive to at least one precision criterion 1010. Example approaches for establishing a precision criterion 1010 are described below with particular reference to FIGS. 11A-11C.

An apparatus 1000 may be utilized in many different environments. Example environments include, but are not limited to: residential, commercial, business, and industrial locations; in external and internal locations; in mobile and fixed applications; in hand-held and static infrastructure usages; combinations thereof; and so forth.

In an example precision attachment operation for an apparatus 1000, the first field emission structure 1004 is configured to interact (correlate) with the second field emission structure 1014 such that the second component 1012 can, when desired, be substantially precisely aligned to become attached (secured) to the first component 1002 or misaligned to become removed (detached) from the first component 1002. In particular, the first component 1002 can be attached to the second component 1012 when their respective first and second field emission structures 1004 and 1014 are located proximate to each other and have a certain alignment with respect to each other (e.g., see FIGS. 12A-12I, 13A, 13B, etc.). In this context, one field emission structure may be considered to be proximate to another field emission structure when they are sufficiently close so as to produce a spatial force in accordance with a predefined spatial force function. Also, one field emission structure may be considered to be proximate to another field emission structure at least when they are in physical contact with each other.

In an example implementation, the first component 1002 is attached to the second component 1012 with a desired strength so as to prevent, or at least render unlikely, the second component 1012 from being inadvertently disengaged from the first component 1002. Moreover, the first component 1002 and the second component 1012 are precisely aligned within a predetermined tolerance level responsive to at least one precision criterion 1010 by configuring the first and second field emission structures 1004 and 1014. The first component 1002 can be released from the second component 1012 when their respective first and second field emission structures 1004 and 1014 are moved with respect to one another to become misaligned.

The process of attaching and detaching the second component 1012 to and from the first component 1002 is achievable because the first and second field emission structures 1004 and 1014 each comprise at least one array (e.g., 1-D, 2-D, etc.) of field emission sources 1006 and 1016 (e.g., an array of magnetic sources), and because each array has sources with positions and polarities relating to a predefined (e.g., desired) spatial force function that corresponds to a predetermined relative alignment of the first and second field emission structures 1004 and 1014 within a field domain 1008 (e.g., see above discussion on correlated magnet technology). In these example applications for securing the first component 1002 to the second component 1012, the first and second field emissions structures 1004 and 1014 both have the same code, but they are a mirror image of one another (see, e.g., FIGS. 3A, 4A, and 12A-12I). An example of how the second component 1012 can be attached (secured) to or removed from the first component 1002 with correlated magnetics is discussed in detail below with particular reference to FIGS. 12A-12I.

In certain example embodiments, the field emission sources (e.g., 302, 308, 400, 404, 1006, 1016, etc.) having designated positive and negative polarity field emissions are configured as part of and to thereby form a field emission structure in accordance with at least one code. The at least one code is selected to establish a correlation between two (or more) field emission structures that can achieve a desired spatial force responsive to a predefined spatial force function. The predefined spatial force function results from two field emission structures being placed in proximity and moved into a predetermined relative alignment with respect to each other. During such relative movement between two field emission structures, a particular field emission source (e.g., of a first field emission structure) having a given polarity may become proximate to a first field emission source (e.g., of a second field emission structure) having the same given polarity as the particular field emission source and at a different time become proximate to a second field emission source (e.g., of the second field emission structure) having an opposite polarity to that of the particular field emission source until the predetermined relative alignment is achieved. In this manner, the particular field emission source may experience both attractive and repulsive forces from different opposing field emission sources during the relative movement.

Figure 11A:
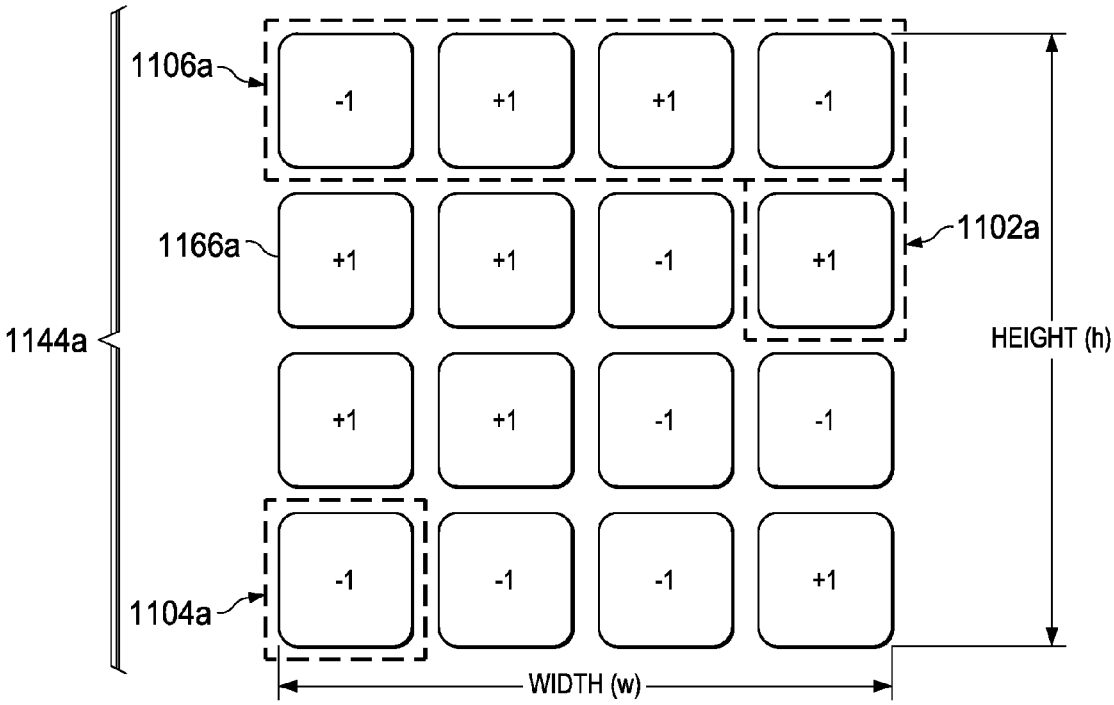
FIGS. 11A-11C are block diagrams of different example field emission structures showing how a field emission structure may be configured responsive to at least one precision criterion.
Figure 11B:
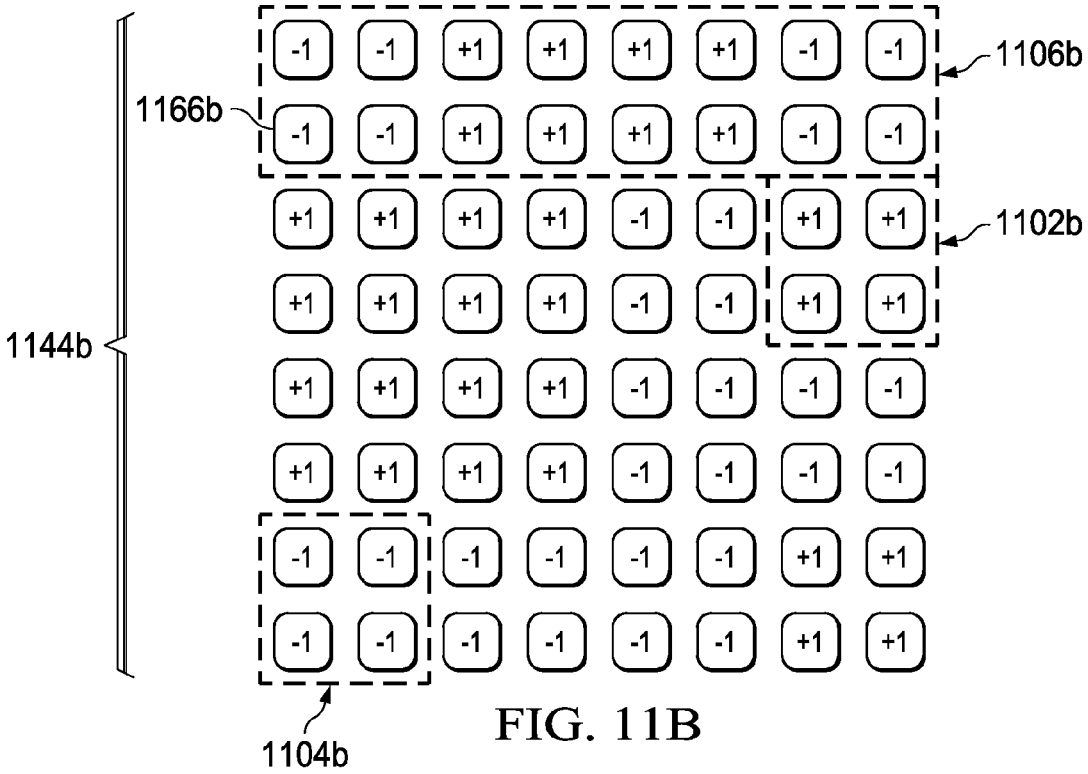
Figure 11C:
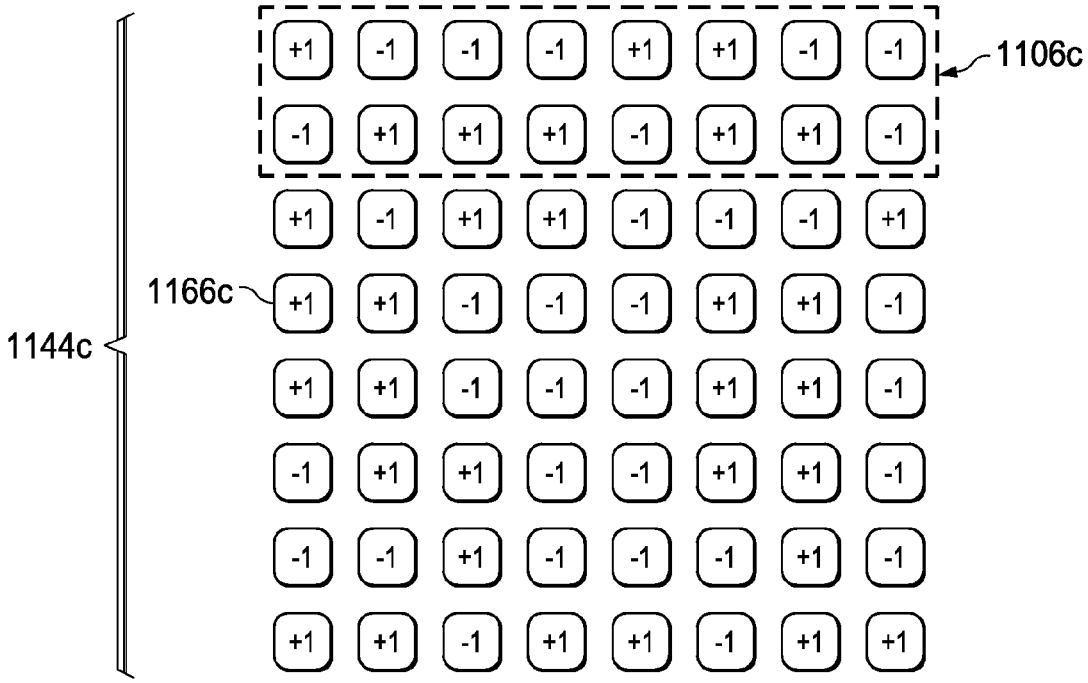

FIGS. 11A, 11B, and 11C are block diagrams of first, second, and third field emission structures 1144*a*, 1144*b*, and 1144*c*, respectively, showing how example field emission structures may be configured responsive to at least one precision criterion. Generally, each field emission structure 1144 is comprised of multiple field emission sources 1166. As illustrated, FIG. 11A shows a first field emission structure 1144*a* having 16 field emission sources 1166*a*. FIG. 11B shows a second field emission structure 1144*b* that has 64 field emission sources 1166*b*. FIG. 11C shows a third field emission structure 1144*c* that also has 64 field emission sources 1166*c*.

For an example implementation, the first field emission structure 1144*a* is a 4×4, two-dimensional array of 16 field emission sources 1166*a*. To describe exemplary principles, a sample code has been applied to the first field emission structure 1144*a*. The sample 4×4 code has the following polarities (left-to-right and top-to-bottom): −1, +1, +1, −1; +1, +1, −1, +1; +1, +1, −1, −1; and −1, −1, −1, +1. The first field emission structure 1144*a* has an overall area established by the 16 field emission sources 1166*a*. In the rectangular (e.g., square) examples of FIGS. 11A-11C, the overall area (A) may be determined by the Height×Width (h×w). Thus, for the first field emission structure 1144*a*, there are sixteen field emission sources 1166*a* in the given area A. Although the field emission structures 1144 and the field emission sources 1166 are shown as being substantially square in shape, the field emission structure 1144 and/or the field emission sources 1166 may have other shapes (e.g., hexagons, circles, ellipses, rectangles, etc.).

Generally, the precision within which two or more field emission structures tend to align increases as the number N of different field emission sources in each field emission structure increases, including for a given surface area A. In other words, alignment precision may be increased by increasing the number N of field emission sources forming two field emission structures. More specifically, alignment precision may be increased by increasing the number N of field emission sources included within a given surface area A. Alignment precision to within a predetermined tolerance level may also be increased by increasing both the number of field emission sources and the overall area of the field emission structure.

Mathematically, the alignment precision or tolerance level (e.g., variance) is related to the square root of N and the total surface area A of the field emission sources forming a field emission structure. For the sake of clarity in the description of FIGS. 11A-11C, the spaces between field emission sources 1166 are considered negligible in the context of determining the overall surface area of field emission structures 1144 and field emission sources 1166. However, depending on the size of the spacing relative to the overall surface area, the spaces between field emission sources may be factored into a precision analysis.

For circular field emission sources, the gross level of precision for attachment of two sources is proportional to the radius of the sources. Improvement in the variance of the attachments is proportional to the square root of the number N of sources. Consequently, the precision or tolerance level of an attachment between two field emission structures may be increased by increasing the number N of field emission sources.

Thus, first and second field emission structures may be designed responsive to at least one precision criterion that is based, for example, (i) on a number of field emission sources in (e.g., each of) the first and second field emission structures and/or (ii) on a total surface area exposed by the field emission sources in each of the first and second field emission structures so as to meet a predetermined attachment tolerance.

Hence, to increase the attachment precision for two components having field emission structures 1144, the number of field emission sources 1166 may be increased, especially for a given surface area A. The total surface area may also be increased along with the number of field emission sources. The first field emission structure 1144*a* (of FIG. 11A) includes 16 field emission sources 1166*a*. In contrast, the second field emission structure 1144*b* (of FIG. 11B) includes 64 field emission sources 1166*b*, and the third field emission structure 1144*c* (of FIG. 11C) also includes 64 field emission sources 1166*c*. The three field emission structures 1144*a*, 1144*b*, and 1144*c* have substantially equal total surface areas A, and the second and third field emission structures 1144*b* and 1144*c* have a greater number of field emission sources than the first field emission structure 1144*a* to thereby provide a greater level of attachment precision. Moreover, the code used to define the third field emission structure 1144*c* has four times the resolution than the code used to define the first and second field emission structures 1144*a* and 1144*b*, which can also improve attachment precision.

Two example approaches for coding field emission structures to have higher precision levels are described. First, the number of field emission sources associated with each code element of a code may be increased. This example approach is illustrated by the second field emission structure 1144*b* in FIG. 11B whereby groups of four field sources correspond to each code element of a code. Second, the number of different code elements of a code used to define polarities of the field sources for the field emission structure may be increased. This example approach is illustrated by the third field emission structure 1144*c* in FIG. 11C.

With reference to FIGS. 11A and 11B, the first and second field emission structures 1144*a* and 1144*b* have substantially similar total surface areas and the same effective coding, which is presented above and illustrated in FIGS. 11A and 11B. However, the second field emission structure 1144*b* of FIG. 11B has four times more field emission sources 1166 than the first field emission structure 1144*a* of FIG. 11A (e.g., 64 field emission sources versus 16). There are first, second, and third indicator rings 1102, 1104, and 1106 in the two figures that are used to compare the field sources of the two field emission structures. Within the first indicator ring 1102*a* of the first field emission structure 1144*a* of FIG. 11A, there is one positive field emission source. Within the first indicator ring 1102*b* of the second field emission source 1144*b* of FIG. 11B, there are four positive field emission sources. Within the second indicator ring 1104*a* of the first field emission structure 1144*a* of FIG. 11A, there is one negative field emission source. Within the second indicator ring 1104*b* of the second field emission source 1144*b* of FIG. 11B, there are four negative field emission sources. Similarly, when comparing the third indicator rings 1106 of the two figures, the third indicator ring 1106*a* of FIG. 11A includes one row of four field emission sources coded −1, +1, +1, −1 corresponding to four code elements of a code, whereas the third indicator ring 1106*b* of FIG. 11B includes two rows of eight field emission sources each coded −1, −1, +1, +1, +1, +1, −1, −1 again corresponding to the same four code elements of the same code. In this manner, the coding of the first field emission structure 1144*a* of FIG. 11A is substantially replicated by the coding of the second field emission structure 1144*b* of FIG. 11B using groups of four field emission sources per code element to increase the level of attachment tolerance for the precise component attachment.

With reference to FIGS. 11B and 11C, a second field emission structure 1144*b* and a third field emission structure 1144*c* have substantially similar total surface areas and the same number of field emission sources, but are coded differently. As previously described, the code for the second field emission structure 1144*b* has groupings of four sources corresponding to the coding of the first field emission structure 1144*a* of FIG. 11A. As such, the code used to describe the first and second field emission structures 1144*a* and 1144*b* comprises 16 code elements. The code for the third field emission structure 1144*c* presented in FIG. 11C is different from the code used to define the sources of FIGS. 11A and 11B. The code used to define the third field emission structure 1144*c* has 64 code elements. As such, when the third indicator ring 1106*b* in FIG. 11B is compared to an indicator ring 1106*c* in FIG. 11C, the difference in coding is evident. Within the third indicator ring 1106*a* of the first field emission structure 1144*a* of FIG. 11A, there are four field emission sources having the following code (left-to-right): −1, +1, +1, −1. Within the third indicator ring 1106*b* of the second field emission source 1144*b* of FIG. 11B, there are 16 field emission sources having the following coding (left-to-right and top-to-bottom): −1, −1, +1, +1, +1, +1, −1, −1, −1, −1, +1, +1, +1, +1, −1, −1. Within the indicator ring 1106*c* of the third field emission structure 1144*c* of FIG. 11C, there are also 16 field emission sources having the different coding (left-to-right and top-to-bottom): +1, −1, −1, −1, +1, +1, −1, −1; −1, +1, +1, +1, −1, +1, +1, −1.

Clearly, the code used to define the polarities of the field sources of the first field emission structure 1144*a* of FIG. 11A is the same as the code used to define the polarities of the field sources of the second field emission structure 1144*b* of FIG. 11B, but a different code is used to define the polarities of the field sources of the third field emission structure 1144*c* of FIG. 11C. Therefore, a fourth field emission structure (not shown) coded to be complementary to (i.e., the mirror image of) the first field emission structure 1144*a* of FIG. 11A would also be complementary to and would substantially align with the second field emission structure 1144*b* of FIG. 11B, but a fifth field emission structure (not shown) coded to be complementary to the third field emission structure 1144*c* of FIG. 11C would not be complementary or substantially align with either the first or second field emission structures 1144*a*, 1144*b* of FIGS. 11A and 11B. Moreover, the fifth field emission structure and the third field emission structure 1144*c* could achieve more precise alignment than the fourth field emission structure and the second field emission structure 1144*b* due to the higher resolution code (i.e., 64 code elements) used to define the third and fifth field emission structures versus the lower resolution code (i.e., 16 code elements) used to define the second and fourth field emission structures.

FIGS. 12A-12I are diagrams that illustrate an example of how first and second (e.g., magnetic) field emission structures can be aligned or misaligned relative to each other to secure a first component to a second component or enable removal of the first component from the second component. Although FIGS. 12A-12I are described with particular reference to the elements of FIG. 10 (and circular field emission structures as shown in FIG. 13A), the principles are also applicable to the elements of other embodiments involving relative rotational movement between two field emission structures generally. There is depicted an exemplary selected first magnetic field emission structure 1004 (associated with first component 1002) and its mirror image second magnetic field emission structure 1014 (associated with second component 1012). Also shown in the form of thicker arrows are the resulting spatial forces produced in accordance with the various alignments as the field emission structures are rotated or twisted relative to each other, which enables one to attach or remove first component 1002 to or from second component 1012.

Figure 12A:
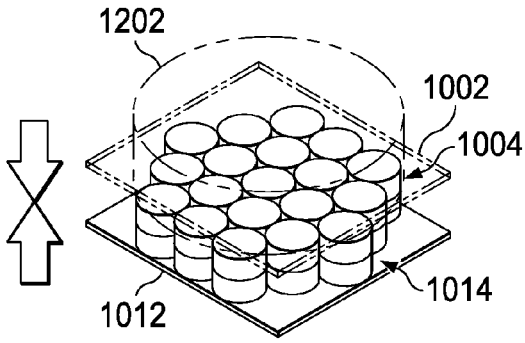
FIGS. 12A-12I are block diagrams that illustrate an example of how first and second field emission structures can be aligned or misaligned relative to each other to enable a first component to be precisely attached to a second component.
Figure 12D:
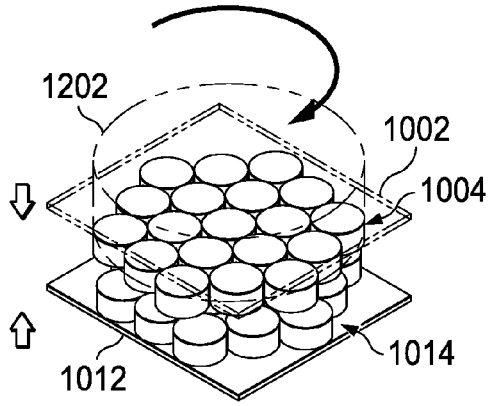
Figure 12B:
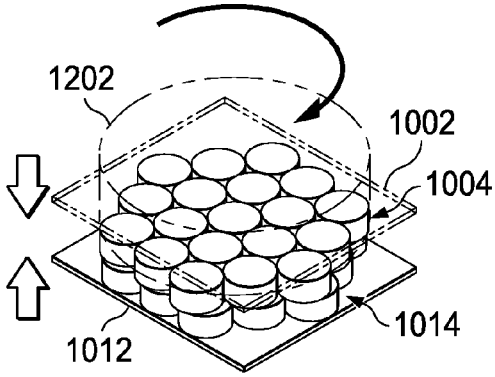

In FIG. 12A, a first magnetic field emission structure 1004 (attached to a first component 1002) and a mirror image second magnetic field emission structure 1014 are aligned to produce a peak spatial force. In FIG. 12B, the first magnetic field emission structure 1004 is rotated via a body 1202 of the first component 1002 clockwise slightly relative to the mirror image second magnetic field emission structure 1014, and the attractive force reduces significantly, as indicated by the smaller arrows. In this example, the second component 1012 is not rotated, but the body 1202 of the first component 1002 is used to rotate the first magnetic field emission structure 1004. Alternatively, the other field emission structure or both field emission structures may be rotated. In FIG. 12C, the first magnetic field emission structure 1004 is further rotated via the first component 1002, and the attractive force continues to decrease. In FIG. 12D, the first magnetic field emission structure 1004 is still further rotated until the attractive force becomes very small, such that the two magnetic field emission structures 1004 and 1014 are easily separated as shown in FIG. 12E.

One skilled in the art would also recognize that the first component 1002 and the second component 1012 can also be detached by applying a pull force, shear force, or any other force sufficient to overcome the attractive peak spatial force between the substantially aligned first and second field emission structures 1004 and 1014. However, these forces may be counterbalanced with sidewall(s); at least one notch, tab, or detent; one or more latches; another pair of field emission structures; some combination thereof; and so forth.

Figure 12E:
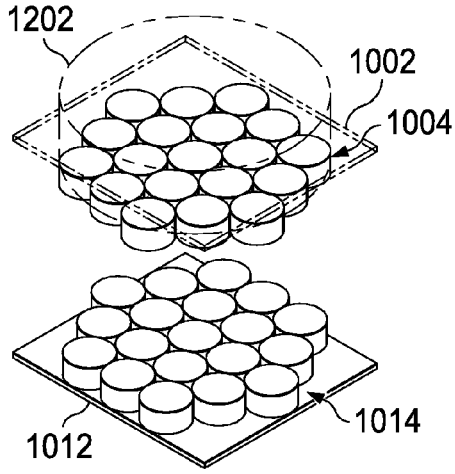
Figure 12C:
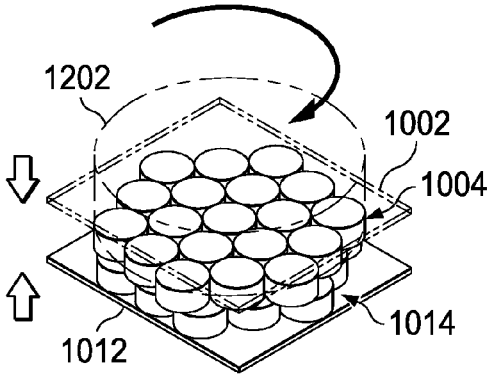
Figure 12F:
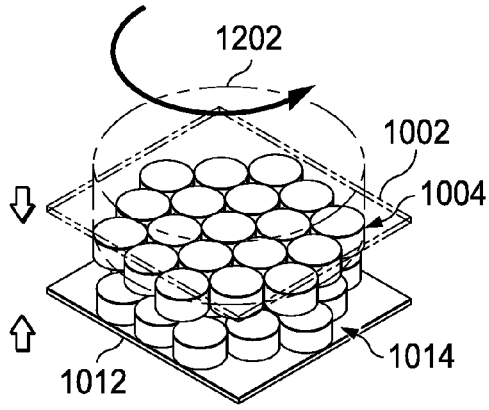
Figure 12G:
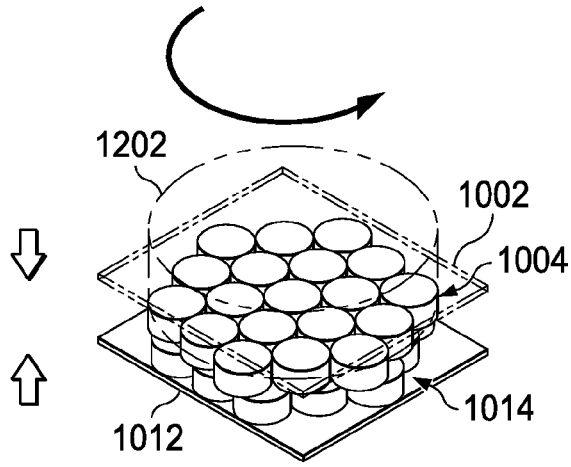
Figure 12H:
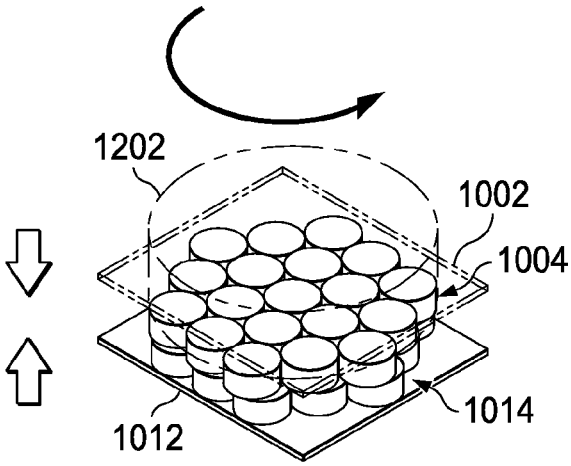
Figure 12I:
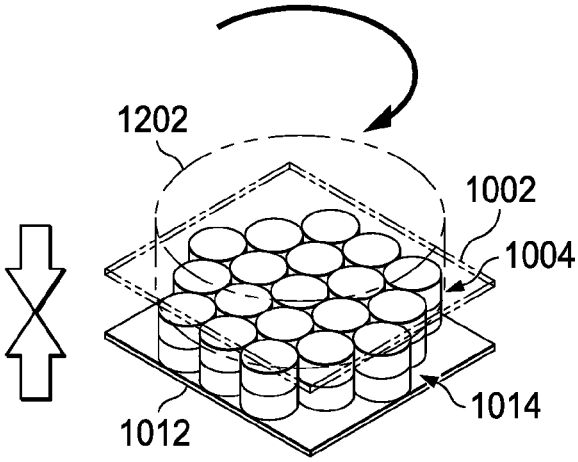
Figure 13A:
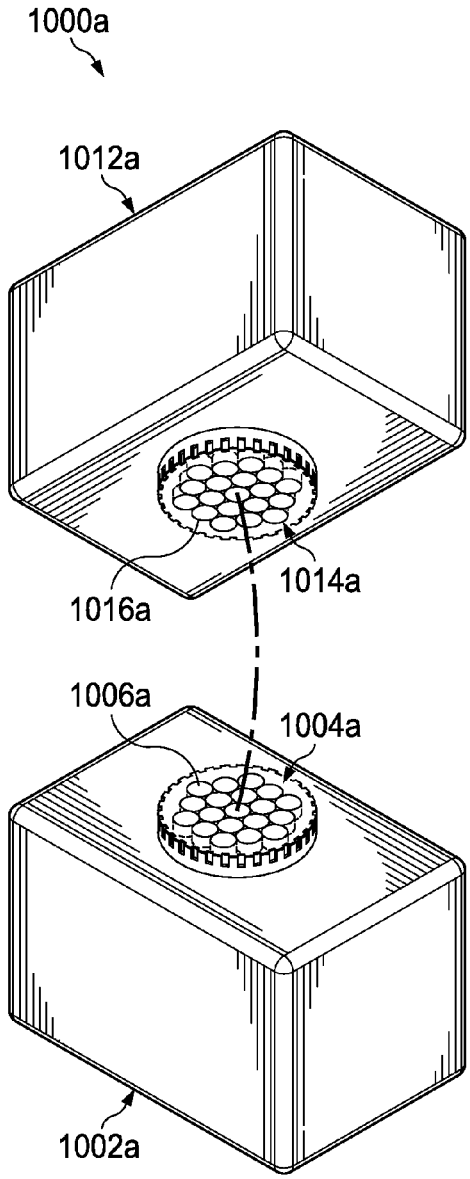
FIG. 13A is a block diagram that illustrates first and second components that may be precisely attached to each other via example first and second field emission structures using a relative rotational movement.

Given that the two magnetic field emission structures 1004 and 1014 are held somewhat apart as in FIG. 12E, the two magnetic field emission structures 1004 and 1014 can be moved closer and rotated towards alignment to produce a small spatial force as in FIG. 12F. The spatial force increases as the two magnetic field emission structures 1004 and 1014 become more and more aligned in FIGS. 12G and 12H, until a peak spatial force is achieved when aligned as in FIG. 12I. It should be noted that the illustrated direction of rotation in FIGS. 12A-12I is arbitrarily chosen, and it may be varied, including in dependence on the code employed. Additionally, the first and second magnetic field emission structures 1004 and 1014 are mirror images of one another, which results in an attractive peak spatial force (see also FIGS. 3-4). This mechanism for reproducibly securing and removing second component 1012 to and from the first component 1002 is a marked-improvement over the prior art, which can involve not only an initial calibration but subsequent recalibrations as well.

The drawings, including FIGS. 12A-12I, show field emission sources of field emission structures as being disposed at least partially "above" (i.e., beyond) a surface of a given component. However, they may be disposed at an alternative altitude. For example, each field emission source may be disposed so as to be recessed at least partially below the surface of the component. Field emission sources may also be flush with the surface of the component on which they are disposed. Also, one component may have recessed field emission sources while a component to be mated thereto may have protruding field emission sources. Other combinations may also be implemented. Moreover, different field emission sources within a single field emission structure may be disposed at different altitudes (e.g., some protruding, some recessed, and/or some flush, etc.).

The drawings, including FIGS. 12A-12I, show first and second field emission structures that may be moved relative to one another without any apparent limitation. However, one or more travel limiters may be included to stop and/or retard the relative movements. Examples for travel limiters include, but are not limited to, tabs, protrusions, detents, ridges, combinations thereof, and so forth. A travel limiter may be used, for instance, so that two field emission structures with varying joint spatial force functions can only be rotated in one direction to attain a peak spatial force function position; the rotational movement would then be reversed to decrease the spatial force function, if desired.

FIG. 13A is a block diagram of an apparatus 1000*a* that illustrates first and second components 1002*a* and 1012*a* that may be precisely attached to each other via example first and second field emission structures 1004*a* and 1014*a* using a relative rotational movement. As illustrated, the first component 1002*a* includes a first field emission structure 1004*a*. The first field emission structure 1004*a* comprises multiple field emission sources 1006*a* having positions and polarities in accordance with a code. The second component 1012*a* includes a second field emission structure 1014*a* that is coded to be complementary to the first field emission structure. The second field emission structure 1014*a* comprises multiple field emission sources 1016*a* having positions and polarities in accordance with the same code but which are configured to be the mirror image of the multiple field emission sources 1006*a* of the first field emission structure 1004*a*.

In an example embodiment, the configuration of first field emission structure 1004*a* and/or second field emission structure 1014*a* is responsive to at least one precision criterion. Accordingly, a number of field emission sources 1006*a* and/or a number of field emission sources 1016*a* may be determined based on a desired level of alignment tolerance. In operation, the first field emission structure 1004*a* is moved (i.e., rotated or rotatably moved) with respect to the second field emission structure 1014*a* to secure the first component 1002*a* to the second component 1012*a*. All or merely a part of either of the bodies of the first and second components 1002*a* and 1012*a* may be involved in the relative movement.

Figure 13B:
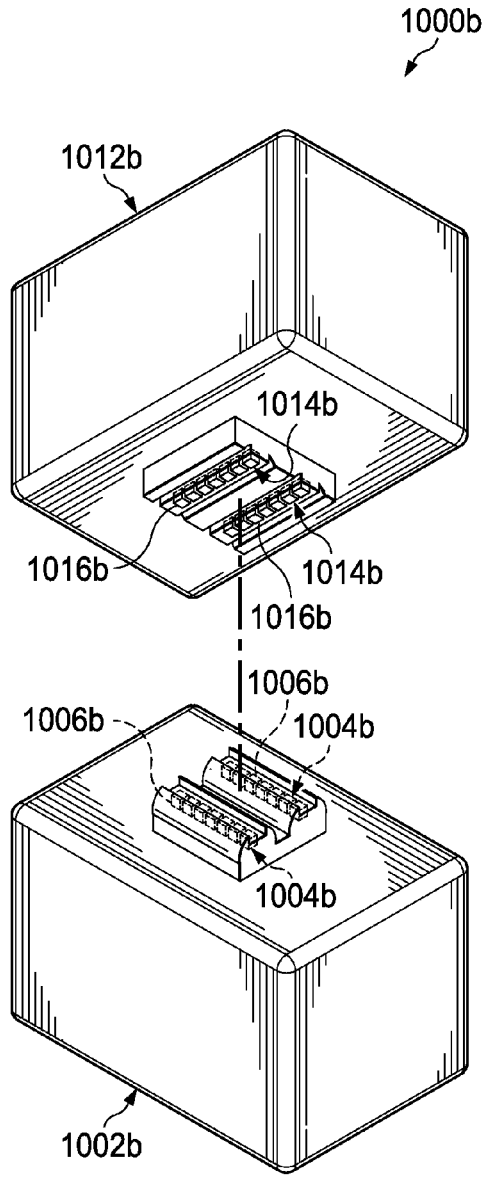
FIG. 13B is a block diagram that illustrates first and second components that may be precisely attached to each other via example first and second field emission structures using a relative linear movement.

FIG. 13B is a block diagram of an apparatus 1000*b* that illustrates first and second components 1002*b* and 1012*b* that may be precisely attached to each other via example first and second field emission structures 1004*b* and 1014*b* using a relative linear movement. As illustrated, the first component 1002*b* includes two first field emission structures 1004*b*. The first field emission structures 1004*b* each comprise multiple field emission sources 1006*b* in accordance with at least one code. The second component 1012*b* includes two second field emission structures 1014*b*. The second field emission structures 1014*b* each comprise multiple field emission sources 1016*b* that are complementary coded in accordance with the at least one code used to define the positions and polarities of the multiple field emission sources 1006*b* of the first field emission structures 1004*b*.

In an example embodiment, the configurations of first field emission structures 1004*b* and/or second field emission structures 1014*b* are responsive to at least one precision criterion. Accordingly, a number of field emission sources 1006*b* and/or a number of field emission sources 1016*b* may be determined based on a desired level of alignment tolerance. In operation, the second field emission structures 1014*b* are moved (i.e., linearly moved) with respect to the first field emission structures 1004*b* to secure the second component 1012*b* to the first component 1002*b*. All or merely a part of either of the bodies of first and second components 1002*b* and 1012*b* may be involved in the relative movement.

As is shown by the example of apparatus 1000*b*, each component (e.g., 1002 and/or 1012) may include multiple field emission structures (e.g., 1004 and/or 1014) for a single precision attachment between two components. Also, the relative sizes of first and second components may be substantially equal (e.g., as shown in FIGS. 13A and 13B), may be significantly different, or may be anywhere in between. Generally, first and second components (e.g., 1002 and/or 1012) may be of any size or sizes, in terms of absolute sizes and relative sizes. It should also be noted that any given component (e.g., 1002 and/or 1012) may have multiple field emission structures (e.g., 1004 and/or 1014) to enable multiple different other components to be precisely attached to the given component.

Although the field emission structures shown in the various FIGURES are illustrated with a particular number of field emission sources (e.g., 7, 8, 19, etc.), these numbers are by way of example only. Alternatively, the field emission structures may include more or fewer than the illustrated numbers of such field emission sources. Generally, field emission structures (e.g., field emission structures 1004 and 1014) can have many different configurations and can be formed from field emission sources comprised of many different types of permanent magnets, electromagnets, electro-permanent magnets, combinations thereof, and so forth. The size, shape (e.g., circles, rectangles, hexagons, etc.), strengths, numbers, and other characteristics of the individual field emission sources may be tailored to meet different goals and/or for different environments.

The field emission structures may be configured in accordance with any code or codes. Moreover, the shape of the field emission structures may be other than a circle or rectangle/line. For example, the field emission structures may be triangular, rectangular, hexagonal, octagonal, ellipsoidal, and so forth. They may also be other shapes, such as a non-solid shape (e.g., an "X"), a star shape, a random shape, and so forth. A field emission structure may also be formed along a perimeter of a shape, such as along the circumference of a circle, rectangle, and so forth. Forming a first field emission structure 1004 and a second field emission structure 1014 along a perimeter (e.g., around a circumference) of a first component 1002 and a second component 1012, respectively, enables a central channel to provide communication between the first and second components. Such a communication channel may be occupied by power wire(s), drive shaft(s), fluid tube(s), light sources, some combination thereof, and so forth.

Thus, for an example embodiment generally, a user roughly aligns first and second field emission structures 1004 and 1014 such that the first component 1002 can be precisely attached to the second component 1012 when the first and second field emission structures 1004 and 1014 are located proximate to one another and have a predetermined alignment with respect to one another such that they correlate with each other to produce a peak attractive spatial force. The user can release the second component 1012 from the first component 1002 by moving the first field emission structure 1004 relative to the second field emission structure 1014 so as to misalign the two field emission structures 1004 and 1014. This process for attaching and detaching a first component 1002 from a second component 1012 is enabled because each of the first and second field emission structures 1004 and 1014 comprises an array of field emission sources 1006 and 1016, respectively, each having positions and polarities relating to a predefined spatial force function that corresponds to a relative alignment of the first and second field emission structures 1004 and 1014 within a field domain.

Moreover, a precise alignment and repeatable attachment may be enabled when the first and second field emission structures 1004 and 1014 are configured responsive to at least one precision criterion 1010. Example implementations of one or more precision criteria are described herein above with particular reference to FIGS. 11A-11C. Each field emission source 1006 or 1016 of each array of field emission sources has a corresponding field emission amplitude and vector direction determined in accordance with the desired predefined spatial force function, where a separation distance between the first and second field emission structures 1004 and 1014 and the relative alignment of the first and second field emission structures 1004 and 1014 creates a spatial force in accordance with the predefined spatial force function. The field domain 1010 corresponds to first field emissions from the array of first field emission sources 1006 of the first field emission structure 1004 interacting with second field emissions from the array of second field emission sources 1016 of the second field emission structure 1014.

FIGS. 14A-17 illustrate different example implementations for first and second components as well as example categories in which apparatuses may be implemented. Although a particular field emission structure configuration is shown in each example figure, any of the illustrated implementations may incorporate any of the field emission structure and field emission source embodiments that are described herein and/or illustrated in the accompanying diagrams. It should be understood that many other implementations and categories beyond those presented in FIGS. 14A-17 are pertinent to embodiments for precisely attaching first and second components.

Figure 14A:
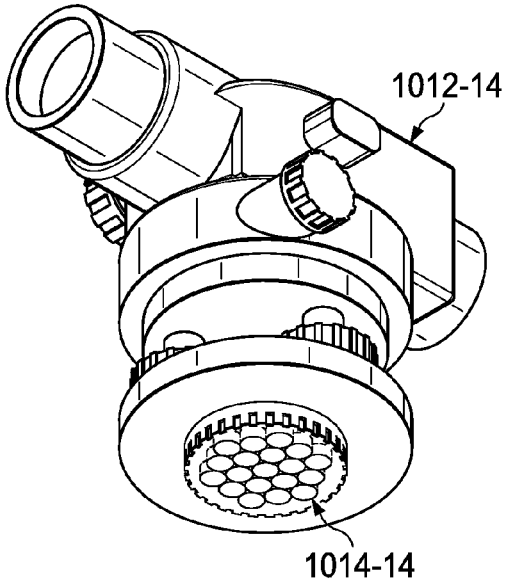
FIGS. 14A and 14B depict example survey-related realizations for second and first components, respectively.
Figure 14B:
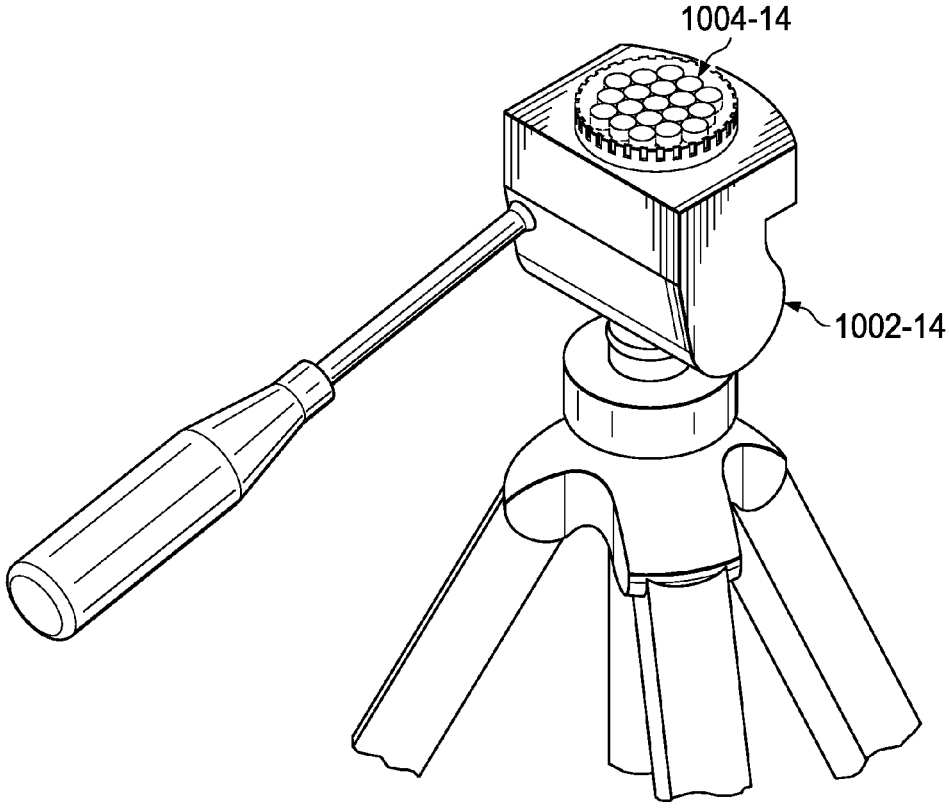

FIGS. 14A and 14B depict example survey-related realizations for second and first components, respectively. FIG. 14A illustrates a second component 1012-14 that is realized as a survey device. Example survey devices include, but are not limited to, levels, lasers, prisms, transit, compass, theodolites, tribrachs, combinations thereof, and so forth. The second component 1012-14 includes a second field emission structure 1014-14 at a location that is conducive to precisely attaching the survey device to a stand or mount, such as a monopod or tripod. FIG. 14B illustrates a first component 1002-14 that is realized as a stand or mount. Specifically, the first component 1002-14 is realized as a tripod. The first component 1002-14 includes a first field emission structure 1004-14 that is complementary to the second field emission structure 1014-14. A user may securely and precisely attach the second component 1012-14 to the first component 1002-14 (e.g., attach a survey device to a tripod) by moving the second field emission structure 1014-14 relative to the first field emission structure 1004-14 after the first and second field emission structures 1004-14 and 1014-14 are brought into proximity with each other such that the complementary sources of the two field emission structures become substantially aligned to produce a peak spatial attractive force. Many other types of objects can be precisely attached to a stand or mount using field emission structures, for example, a weapon, a light fixture, or an optical device like that described in relation to FIGS. 15A and 15B.

Figure 15A:
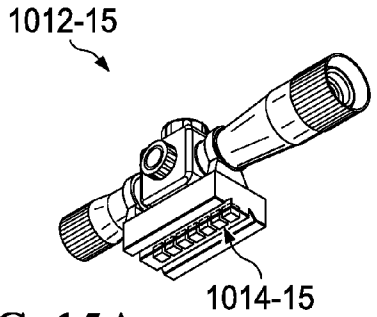
FIGS. 15A and 15B depict example firearm-related realizations for second and first components, respectively.
Figure 15B:
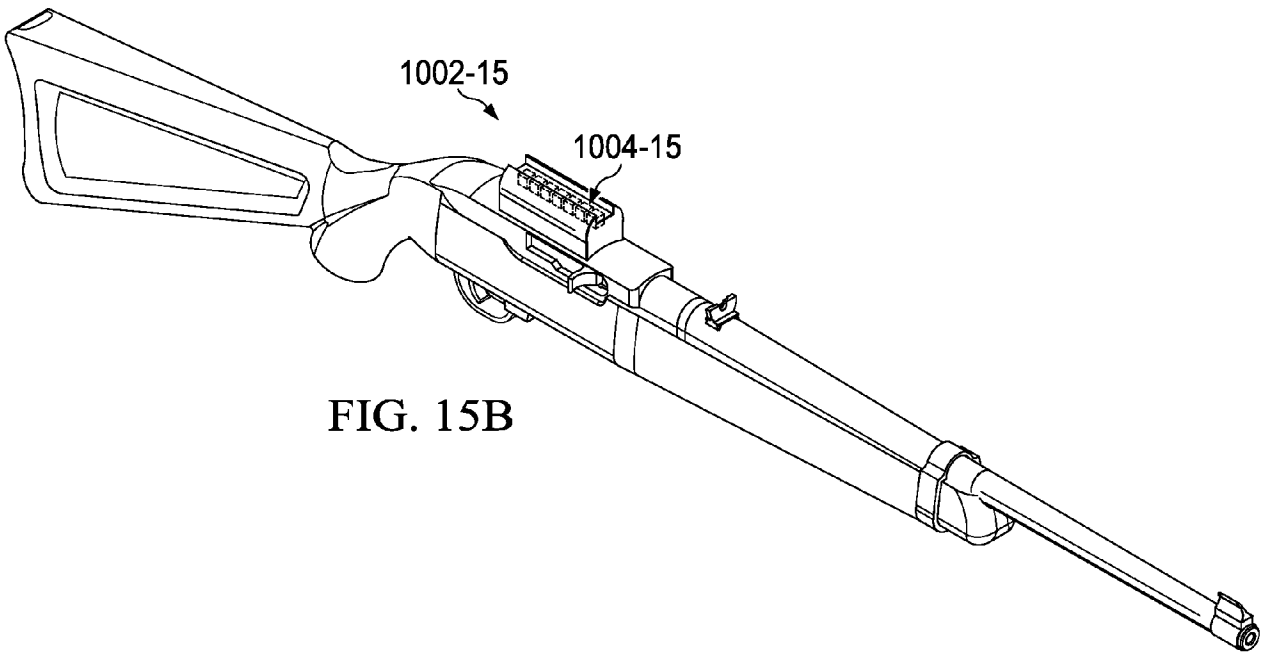

FIGS. 15A and 15B depict example firearm-related realizations for second and first components, respectively. FIG. 15A illustrates a second component 1012-15 that is realized as an optical device. Example optical devices include, but are not limited to, binoculars/night vision goggles, rifle scopes, cameras and camera lenses, microscopes/telescopes, optometry/ophthalmic equipment, fiber optic equipment, combinations thereof, and so forth. Specifically, the second component 1012-15 is realized as a rifle scope. The second component 1012-15 includes a second field emission structure 1014-15 at a location that is conducive to precisely attaching the optical device to a weapon, such as a rifle. FIG. 15B illustrates a first component 1002-15 that is realized as a weapon. Specifically, the first component 1002-15 is realized as a rifle. The first component 1002-15 includes a first field emission structure 1004-15 that is complementary to the second field emission structure 1014-15. A user may securely and precisely attach the second component 1012-15 to the first component 1002-15 (e.g., attach a rifle scope to a rifle) by moving the second field emission structure 1014-15 relative to the first field emission structure 1004-15 after the first and second field emission structures 1004-15 and 1014-15 are brought into proximity to each other such that the complementary sources of the two field emission structures become substantially aligned to produce a peak spatial attractive force.

Figure 16A:
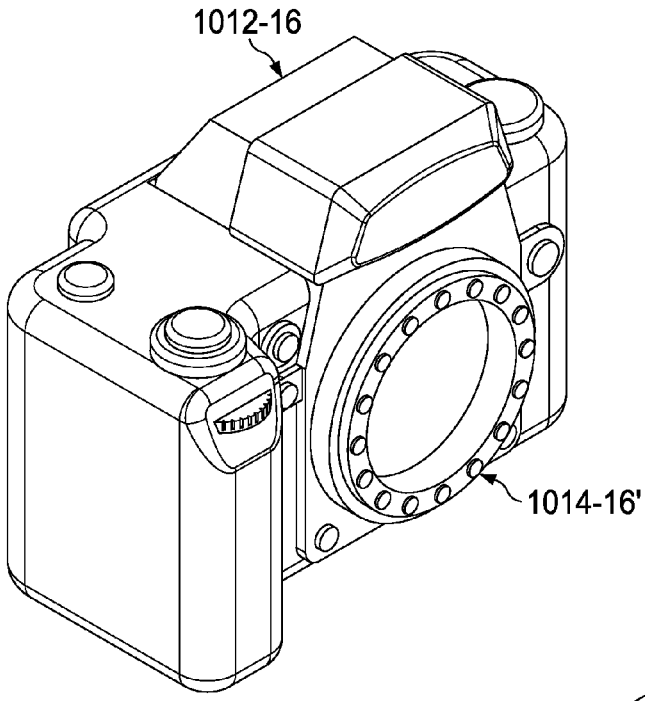
FIGS. 16A, 16B, and 16C depict example camera-related realizations for second, first, and second components, respectively.
Figure 16B:
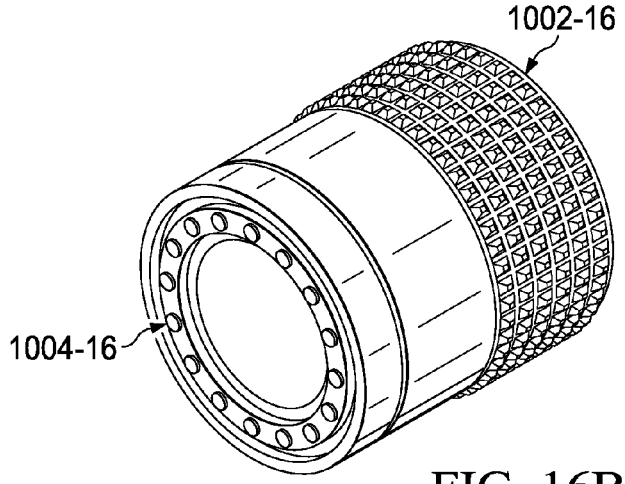
Figure 16C:
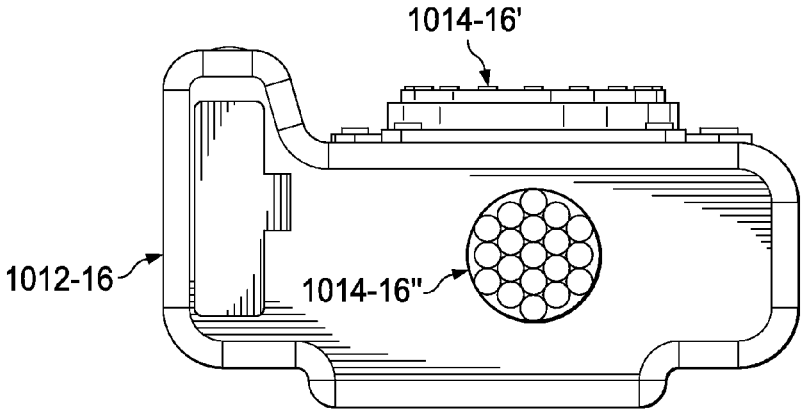

FIGS. 16A, 16B, and 16C depict example camera-related realizations for second, first, and second components, respectively. FIG. 16A illustrates in a front view a second component 1012-16 that is realized as a camera body (e.g., for a fixed image and/or video camera). The second component 1012-16 includes a second field emission structure 1014-16'. FIG. 16B illustrates a first component 1002-16 that is realized as a camera lens. The first component 1002-16 includes a first field emission structure 1004-16 that is complementary to the second field emission structure 1014-16'. The first and second field emission structures 1004-16 and 1014-16' are each configured as a circular ring. To securely and precisely attach first component 1002-16 to second component 1012-16 (e.g., to attach a camera lens to a camera), a user brings first and second field emission structures 1004-16 and 1014-16' into proximity with each other and then moves the first field emission structure 1004-16 relative to the second field emission structure 1014-16' such that the complementary sources of the two field emission structures become substantially aligned to produce a peak spatial attractive force.

FIG. 16C illustrates the second component 1012-16 in a different view, a bottom view. Thus, FIG. 16C shows the bottom of a camera. The second component 1012-16 includes another second field emission structure 1014-16". The second component 1012-16 may be securely and precisely attached to a stand, such as a first component 1002-14 (of FIG. 14B), using the second field emission structure 1014-16". After a user brings first and second field emission structures 1004-14 and 1014-16" in proximity to each other, a relative movement between them can secure the second component 1012-16 to the first component 1002-14 (e.g., to secure a camera to a tripod) when the complementary sources of the two field emission structures become substantially aligned to produce a peak spatial attractive force.

As is apparent from the description herein, especially for FIGS. 16A, 16B, and 16C, the terms "first component" and "second component" may be arbitrarily and/or interchangeably applied to any two components. In other words, the terms "first component" and "second component" are used herein for the sake of clarity to refer to two components that are to be securely and precisely attached to each other. Although the illustrated diagrams generally depict one component being securely and precisely attached to an exterior portion of another component, one component may alternatively be securely and precisely attached to an interior portion of another component.

Figure 17:
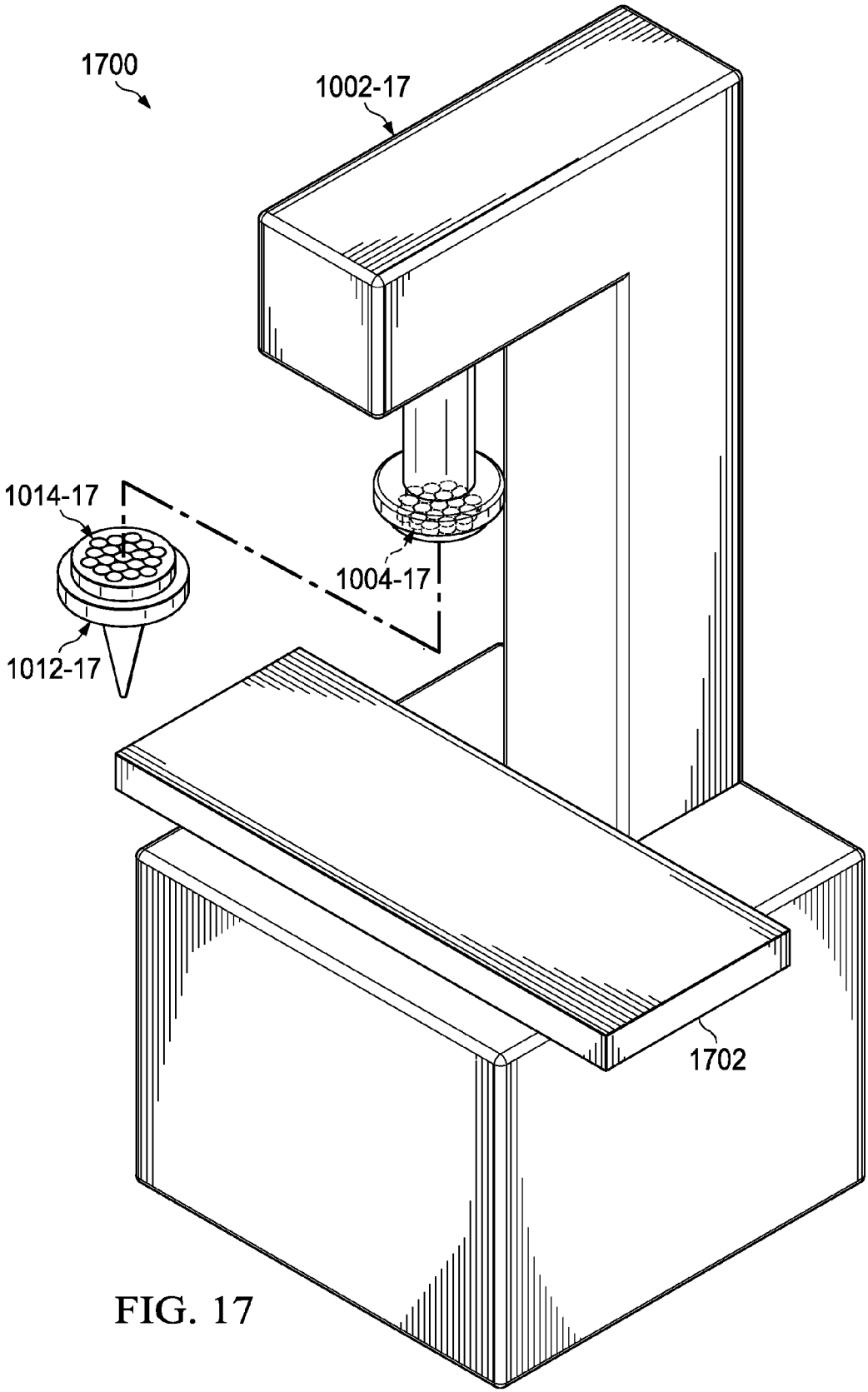
FIG. 17 depicts example equipment-related realizations for first and second components.

FIG. 17 depicts example equipment-related realizations for first and second components. Specifically, FIG. 17 illustrates a first component 1002-17 and a second component 1012-17. The first component 1002-17 is realized as, e.g., manufacturing equipment or medical equipment. The second component 1012-17 is realized as a device or mechanism that attaches to the manufacturing/medical equipment to facilitate the performance of some task by the equipment. The first component 1002-17 includes a first field emission structure 1004-17. The second component 1012-17 includes a second field emission structure 1014-17. The manufacturing/medical equipment is shown operating on an item 1702. The nature of the item 1702 depends on what the equipment is designed to manufacture or what medical procedure the equipment is designed to perform. In this context, manufacturing may include constructing, repairing, maintaining, refurbishing, augmenting, etc. some item 1702. Hence, the item 1702 may be a substance, structural part, etc. that is being manufactured/produced, a portion of a living creature (e.g., a human undergoing a medical procedure), and so forth.

In an example component installation operation, a user places the second component 1012-17 near the first component 1002-17 such that the second field emission structure 1014-17 is located proximate to the first field emission structure 1004-17. The user then moves the first field emission structure 1004-17 relative to the second field emission structure 1014-17 so as to align them such that a peak spatial force is created. When the first and second field emission structures 1004-17 and 1014-17 are configured responsive to at least one precision criterion, the second component 1012-17 is precisely attached to the first component 1002-17. Although the second component 1012-17 is shown being coupled to an external portion of the first component 1002-17, it may alternatively be coupled fully or partially to an internal portion of the first component 1002-17.

The precise attachment mechanism is enabled by the first and second field emission structures that are configured responsive to at least one precision criterion. Consequently, the performance of initial measurements and/or calibrations may be obviated when the second component 1012-17 is precisely attached to the first component 1002-17. Furthermore, the performance of periodic measurements and/or recalibrations may be obviated with the precise attachment enabled by the first field emission structure 1004-17 and the second field emission structure 1014-17. Analogous benefits may be attained generally with the first and second field emission structures 1004 and 1014 that are configured responsive to at least one precision criterion.

Figure 18:
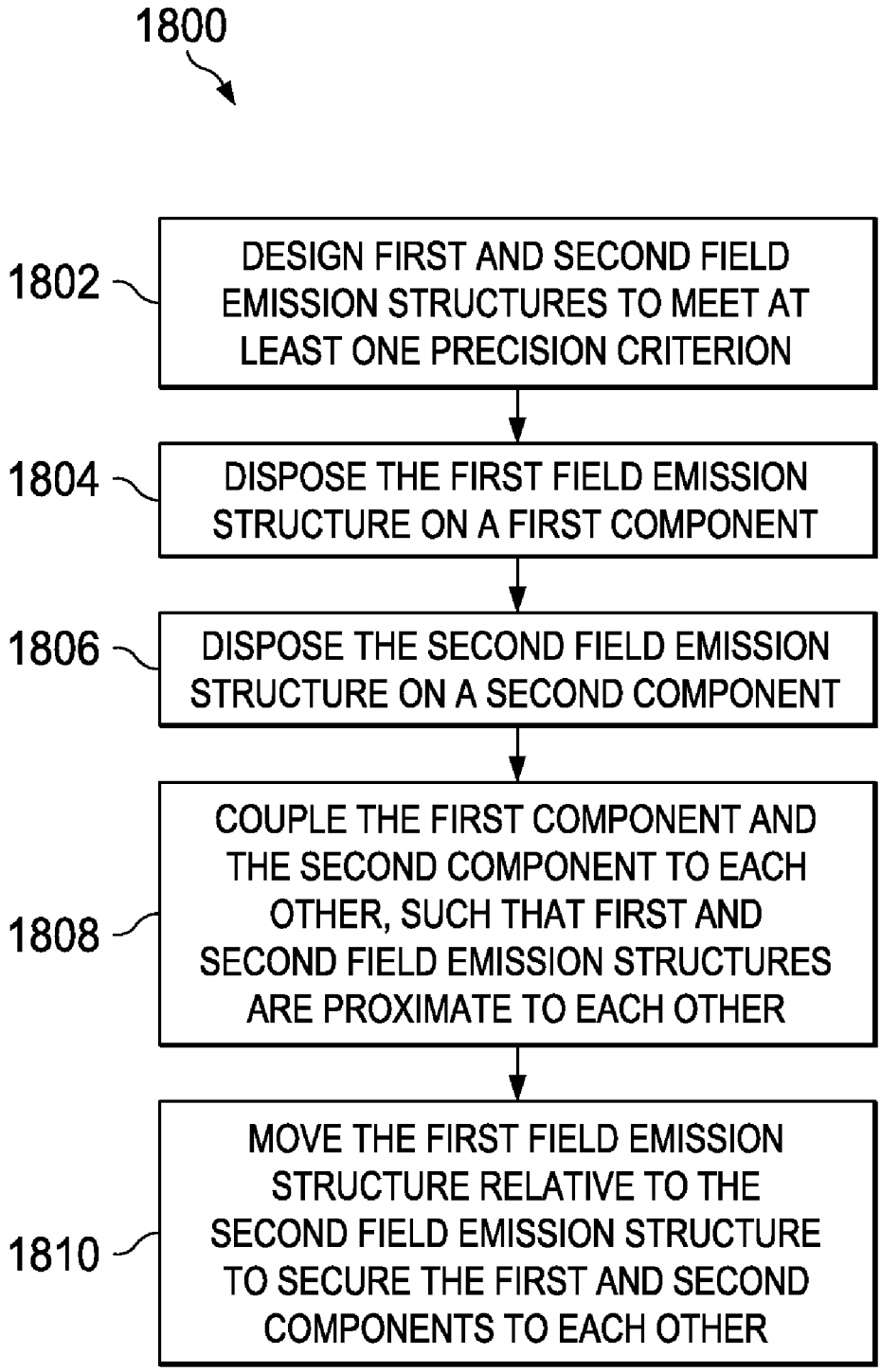
FIG. 18 is a flow diagram that illustrates an example method for constructing first and second components that may be precisely attached to each other via first and second field emission structures to form an apparatus.

FIG. 18 is a flow diagram 1800 that illustrates an example method for constructing first and second components that may be precisely attached to each other via first and second field emission structures to form an apparatus. As illustrated, the flow diagram 1800 includes five steps 1802-1810. Although the five steps 1802-1810 are shown and described in a particular order, they may be performed in different orders and/or in a fully or partially overlapping manner. Generally, the first three steps 1802, 1804, and 1806 pertain to constructing components of an apparatus that may be precisely assembled, and the last two steps 1808 and 1810 pertain to assembling/attaching the components into the apparatus.

In an example embodiment, for a first step 1802, first and second field emission structures are designed to meet at least one precision criterion. For example, the first and second field emission structures 1004 and 1014 may be designed to meet at least one precision criterion 1010, as is described hereinabove with particular reference to FIGS. 11A-11C. Although particular elements from other FIGURES are mentioned in the description of FIG. 18, the steps of flow diagram 1800 may alternatively be performed in other manners and/or with other elements.

For a second step 1804, the first field emission structure is disposed on a first component. For example, the first field emission structure 1004 may be disposed on a first component 1002. For a third step 1806, the second field emission structure is disposed on a second component. For example, the second field emission structure 1014 may be disposed on a second component 1012. The first and second field emission structures 1004 and 1014 are configured responsive to at least one precision criterion 1010.

A given step of disposing may be accomplished by attaching a field emission structure to a component, by integrating a field emission structure with a component, some combination thereof, and so forth. For example, disposing may be accomplished by adhering a field emission structure to a component; by inserting, injecting, or otherwise imposing a field emission structure onto/into a component; by creating a component so as to include a field emission structure "baked in"; some combination thereof, and so forth. Multiple field emission sources 1006 and/or 1016 may be disposed simultaneously or sequentially.

For the fourth step 1808, the first component and the second component are coupled to each other such that first and second field emission structures are proximate to each other. For example, the first component 1002 and the second component 1012 may be coupled to each other such that the first and second field emission structures 1004 and 1014 are proximate to each other. After the coupling step and/or at least partially simultaneously with the step of coupling, the field emission structures are moved relative to each other, as explained with reference to step 1810.

For the fifth step 1810, the first field emission structure is moved relative to the second field emission structure to secure the first and second components to each other. For example, the first and second field emission structures 1004 and 1014 may be moved relative to each other to secure the first component 1002 to the second component 1012. More specifically, the first field emission structure may be moved relative to the second field emission structure to increase a current spatial force between the first and second field emission structures in accordance with a predefined spatial force function to thereby secure the first and second components to each other via, at least partially, the current spatial force. A total current spatial force may be attractive, repulsive, or some combination thereof in dependence on the coding used to configure the field emission sources and a current relative alignment between the field emission structures.

In the description above, a number of categorical applications and specific-use examples have been provided. However, these examples are non-exhaustive. Additional examples are also provided below. Categorical applications include, but are not limited to: optics, prosthetics, surveying equipment, metalworking/machining and woodworking equipment, medical equipment, manufacturing equipment generally, robotic equipment, metrology equipment, scientific measuring/metering and testing equipment, flat panel display manufacturing equipment, semiconductor device fabrication equipment, combinations thereof, and so forth. Specific-use examples include, but are not limited to: cameras, binoculars, night-vision goggles, microscopes, telescopes, gun scopes, fiber optical connections, saws, coaters, drills, cutters, grinders, polishers, dental appliances, chucks, magnetic bases, lathes, milling equipment, welding machines, tripods, magnetic resonance imaging (MRI) machines, combinations thereof, and so forth. It should be noted that not only are the different categorical applications and specific-use examples not exhaustive, they are also not mutually exclusive. An apparatus may relate to two or more categories and/or have two or more specific uses.

Although multiple example embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims. It should also be noted that the reference to the "present invention" or "invention" as used herein relates to exemplary embodiments and not necessarily to every embodiment that is encompassed by the appended claims.

The invention claimed is:

1. An apparatus comprising:

a first component including a first field emission structure; and a second component including a second field emission structure; the first and second components adapted to be attached to each other with the first field emission structure in proximity to the second field emission structure such that the first and second field emission structures have a predetermined alignment with respect to each other; each of the first and second field emission structures including multiple field emission sources having positions and polarities relating to a predefined spatial force function that corresponds to the predetermined alignment of the first and second field emission structures within a field domain; the first and second field emission structures configured responsive to at least one precision criterion, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

2. The apparatus as recited in claim 1, wherein the first component and the second component may be attached or detached from each other by moving the first and second field emission structures relative to each other.

3. The apparatus as recited in claim 2, wherein the relative movement between the first field emission structure and the second field emission structure to attach or detach the first and second components to each other comprises at least a relative rotational movement between the first field emission structure and the second field emission structure.

4. The apparatus as recited in claim 2, wherein the relative movement between the first field emission structure and the second field emission structure to attach or detach the first and second components to each other comprises at least a relative linear movement between the first field emission structure and the second field emission structure.

5. The apparatus as recited in claim 1, wherein at least one of the first component or the second component includes at least one other field emission structure.

6. The apparatus as recited in claim 1, wherein the positions and the polarities of the field emission sources of the first and second field emission structures are configured in accordance with at least one correlation function.

7. The apparatus as recited in claim 6, wherein the at least one correlation function comports with at least one code.

8. The apparatus as recited in claim 7, wherein the at least one code comprises at least one of a pseudorandom code, a deterministic code, or a designed code; and wherein the at least one code comprises a one dimensional code, a two dimensional code, a three dimensional code, or a four dimensional code.

9. The apparatus as recited in claim 1, wherein each field emission source of the multiple field emission sources has a corresponding field emission amplitude and vector direction configured in accordance with the predefined spatial force function, wherein a separation distance between the first and second field emission structures and the predetermined alignment with respect to the first and second field emission structures creates a spatial force in accordance with the predefined spatial force function.

10. The apparatus as recited in claim 9, wherein the spatial force corresponds to a peak spatial force of the predefined spatial force function when the first and second field emission structures are substantially aligned such that each field emission source of the first field emission structure substantially aligns with a corresponding field emission source of the second field emission structure.

11. The apparatus as recited in claim 1, wherein at least one field emission source of the multiple field emission sources includes a magnetic field emission source or an electric field emission source.

12. The apparatus as recited in claim 1, wherein the field domain corresponds to first field emissions from the field emission sources of the first field emission structure interacting with second field emissions from the field emission sources of the second field emission structure.

13. The apparatus as recited in claim 1, wherein the at least one precision criterion is based on a number of field emission sources in each of the first and second field emission structures.

14. The apparatus as recited in claim 13, wherein the at least one precision criterion is further based on a total surface area exposed by the field emission sources in each of the first and second field emission structures; and wherein the positions and the polarities of the field emission sources of the first and second field emission structures are configured in accordance with at least one code.

15. The apparatus as recited in claim 1, wherein the first component or the second component comprises at least part of medical equipment or manufacturing equipment.

16. A method relating to an apparatus including a first component and a second component, the method comprising:

disposing a first field emission structure on the first component; and disposing a second field emission structure on the second component;

wherein the first and second components are adapted to be attached to each other with the first field emission structure in proximity to the second field emission structure such that the first and second field emission structures have a predetermined alignment with respect to each other; each of the first and second field emission structures including multiple field emission sources having positions and polarities relating to a predefined spatial force function that corresponds to the predetermined alignment of the first and second field emission structures within a field domain; the first and second field emission structures configured responsive to at least one precision criterion, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

17. The method as recited in claim 16, further comprising:

coupling the first component and the second component to each other; and moving the first field emission structure relative to the second field emission structure to increase a current spatial force between the first and second field emission structures in accordance with the predefined spatial force function to thereby secure the first and second components to each other via the current spatial force.

18. The method as recited in claim 16, further comprising:

designing the first and second field emission structures responsive to the at least one precision criterion that is based on a number of field emission sources in each of the first and second field emission structures and on a total surface area exposed by the field emission sources in each of the first and second field emission structures so as to meet a predetermined attachment tolerance.

19. A first component that is capable of being attached to a second component, the second component including a second field emission structure; the first component comprising:

a body; and a first field emission structure that is disposed on the body; the first component adapted to be attached to the second component with the first field emission structure in proximity to the second field emission structure such that the first and second field emission structures have a predetermined alignment with respect to each other; each of the first and second field emission structures including multiple field emission sources having positions and polarities relating to a predefined spatial force function that corresponds to the predetermined alignment of the first and second field emission structures within a field domain; the first and second field emission structures configured responsive to at least one precision criterion, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

20. The first component as recited in claim 19, wherein one or more field emission sources of the multiple field emission sources include at least one permanent magnet, electromagnet, electret, magnetized ferromagnetic material, portion of a magnetized ferromagnetic material, soft magnetic material, or superconductive magnetic material.

* * * * *